US009540751B2

(12) United States Patent
Tseng

(10) Patent No.: US 9,540,751 B2
(45) Date of Patent: Jan. 10, 2017

(54) SEWING MACHINE WITH A THREADING AND AIR SUPPLY SELECTING DEVICE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 426 days.

(21) Appl. No.: 14/292,812

(22) Filed: May 30, 2014

(65) Prior Publication Data

US 2015/0284890 A1 Oct. 8, 2015

(30) Foreign Application Priority Data

Apr. 8, 2014 (TW) ..... 103112806 A

(51) Int. Cl.
*D05B 87/00* (2006.01)
*D05B 53/00* (2006.01)

(52) U.S. Cl.
CPC ..... *D05B 53/00* (2013.01); *D05B 87/00* (2013.01); *D05D 2207/04* (2013.01)

(58) Field of Classification Search
CPC ..... D05B 53/00; D05B 87/00; D05B 57/00; D05B 57/06; D05B 57/08; D05B 62/22; D05B 87/02; D05B 87/04
USPC ..... 112/224, 225, 302, DIG. 3
See application file for complete search history.

(56) References Cited

U.S. PATENT DOCUMENTS

| | | | | |
|---|---|---|---|---|
| 5,327,841 | A * | 7/1994 | Sakuma | D05B 87/00 112/162 |
| 7,523,712 | B2 * | 4/2009 | Sadasue | D05B 1/10 112/199 |
| 7,536,964 | B2 * | 5/2009 | Sadasue | D05B 57/30 112/199 |
| 9,290,872 | B2 * | 3/2016 | Ishikawa | D05B 63/00 |
| 9,347,163 | B2 * | 5/2016 | Sakuma | D05B 63/00 |
| 2012/0210922 | A1 * | 8/2012 | Sakuma | D05B 87/00 112/199 |
| 2014/0083344 | A1 * | 3/2014 | Sakuma | D05B 87/00 112/199 |

FOREIGN PATENT DOCUMENTS

| | | |
|---|---|---|
| TW | 46553 U | 9/1982 |
| TW | 193730 B | 11/1992 |
| TW | I402391 B1 | 7/2013 |

* cited by examiner

*Primary Examiner* — Nathan Durham
(74) *Attorney, Agent, or Firm* — Bruce Stone, LLP; Joseph A. Bruce

(57) ABSTRACT

A sewing machine with a threading and air supply selecting device includes a base with a main shaft for driving at least one thread wiper, and a guiding pipe is provided on the thread wiper. On the base is further disposed an air supply device driven by a drive force source. Between the air supply source and he guiding pipe is disposed a pipe-moving device for moving the connecting pipe to the guiding pipe. A swing arm of a connecting rod assembly serves to control ON and Off of the air supply source. A directional positioning device is used to stop the main shaft from rotation, when the air supply source is working.

18 Claims, 18 Drawing Sheets

SEWING MACHINE WITH A THREADING AND AIR SUPPLY SELECTING DEVICE

BACKGROUND OF THE INVENTION

Field of the Invention

The present invention relates to a sewing machine, and more particularly to a sewing machine with a threading and air supply selecting device.

Description of the Prior Art

Sewing machines have a variety forms, for example, overlock sewing machine is provided with a main shaft which is used to drive the needle and a plurality of thread wipers. In order for easy and quick threading of the upper thread hook, many automatic threading devices have been invented. For instance, Taiwan Patent No. 46553 discloses an automatic needle threading device which threads the needle by a jet of air. Taiwan Patent Nos. 193730 and 1402391 also disclose a device for threading the thread wiper by a jet of air, wherein the air introduction system is a retractile pipe. The movement of the air source or the main shaft can not be effectively controlled during the movement of the air introduction system, which results in inconvenience in air supplying, and the ON and OFF of the drive force source cannot be effectively controlled, leading to safety concerns.

The present invention has arisen to mitigate and/or obviate the afore-described disadvantages.

SUMMARY OF THE INVENTION

The primary objective of the present invention is to provide a sewing machine with a threading and air supply selecting device, wherein the air supply operation is precisely controllable, and the action of the drive force source and relative components can also be safely controlled.

To achieve the above objective, a sewing machine with a threading and air supply selecting device in accordance with the present invention comprises: a base, a drive force source, a main shaft driven by the drive force source, at least one thread wiper driven by the main shaft, and a guiding pipe provided on the thread wiper, each of the guiding pipes having one end extended to a thread-inserting hole, of the thread wiper, and another end fixed to a pipe-guiding frame of the thread wiper; characterized in that:

the drive force source driving an air supply device, between the air-supply device and the pipe-guiding frames is disposed a pipe-moving device which includes a pipe-moving frame and a connecting pipe mounted on the pipe-moving frame and connected to the air supply device, the pipe-moving frame is provided at one end thereof with a main guiding member, a position where the main guide member moves to a connection between the connecting pipe and the guiding pipe is defined as a first position, and a position where the main guiding member moves away from the connection between the connecting pipe and the guiding pipe is defined as a second position; and the main guiding member has one end connected to one end of a swing arm, another end of the swing arm is abutted against an air-supply clutch, the air-supply clutch is disposed on a power shaft of the drive force source, the swing arm, when in the first position, controls the air-supply clutch to transmit a drive force of the power shaft to the air supply device, or, the swing arm, when in the second position, controls the air-supply clutch to stop transmitting the drive force of the power shaft to the air supply device.

To achieve the above objective, a sewing machine with a threading and air supply selecting device in accordance with the present invention comprises: a base, a drive force source, a main shaft driven by the drive force source, at least one thread wiper driven by the main shaft, and a guiding pipe provided on the thread wiper, each of the guiding pipes having one end extended to a thread-inserting hole of the thread wiper, and another end fixed to a pipe-guiding frame of the thread wiper; characterized in that:

an air supply device;

a pipe-moving device is disposed at the pipe-guiding frames and includes a pipe-moving frame and a connecting pipe mounted on the pipe-moving frame and connected to the air supply device, the pipe-moving frame is provided at one end thereof with a main guiding member, a position where the main guide member moves to a connection between the connecting pipe and the guiding pipe is defined as a first position, and a position where the main guiding member moves away from the connection between the connecting pipe and the guiding pipe is defined as a second position, the air supply device supplies air to the connecting pipe in the first position; and between the main guiding member and the main shaft is disposed a directional positioning device, the main guiding member includes a guiding edge with height difference, the guiding edge has a first end and a second end lower than the first end, the directional positioning device includes a limiter, and a rotation-stopping member mounted on the main shaft, the limiter has a middle section pivoted to the base, and has an abutting end protruding upward between the restricting member and the main guiding member, and a stop end protruding upward toward the main shaft, the abutting end is abutted against the guiding edge, the rotation-stopping member is provided with a rotation-stopping slot, when the pipe-moving frame is located in the first position, the abutting end will move to the second end of the guiding edge, and when the main shaft rotates to a position where the guiding pipe is aligned to the connecting pipe, the stop end will be engaged in the rotation-stopping slot to stop the main shaft from rotating, when the pipe-moving frame moves to the second position, the abutting end will move to the first end of the guiding edge, the stop end will be disengaged from the rotation-stopping slot to permit rotation of the main shaft.

To achieve the above objective, a sewing machine with a threading and air supply selecting device in accordance with the present invention comprises: a base, a drive force source, a main shaft driven by the drive force source, at least one thread wiper driven by the main shaft, and a guiding pipe provided on the thread wiper, each of the guiding pipes having one end extended to a thread-inserting hole of the thread wiper, and another end fixed to a pipe-guiding frame of the thread wiper; characterized in that:

the drive force source driving an air supply device, between the air-supply device and the pipe-guiding frames is disposed a pipe-moving device which includes a pipe-moving frame and a connecting pipe mounted on the pipe-moving frame and connected to the air supply device, the pipe-moving frame is provided at one end thereof with a main guiding member, a position where the main guide member moves to a connection between the connecting pipe and the guiding pipe is defined as a first position, and a position where the main guiding member moves away from the connection between the connecting pipe and the guiding pipe is defined as a second position; and between the main guiding member and the main shaft is disposed a directional positioning device, the main guiding member includes a guiding edge with height difference, the guiding edge has a first end and a second end lower than the first end, the directional positioning device includes a limiter, and a rotation-stopping member mounted on the main shaft, the limiter has a middle section pivoted to the base, and has an abutting end protruding upward between the restricting member and the main guiding member, and a stop end protruding upward toward the main shaft, the abutting end is abutted against the guiding edge, the rotation-stopping member is provided with a rotation-stopping slot, when the pipe-moving frame is located in the first position, the abutting end will move to the second end of the guiding edge, and when the main shaft rotates to a position where the guiding pipe is aligned to the connecting pipe, the stop end will be engaged in the rotation-stopping slot to stop the main shaft from rotating, when the pipe-moving frame moves to the second position, the abutting end will move to the first end of the guiding edge, the stop end will be disengaged from the rotation-stopping slot to permit rotation of the main shaft;

the main guiding member has one end connected to one end of a swing arm, another end of the swing arm is abutted against an air-supply clutch, the air-supply clutch is disposed on a power shaft of the drive force source, the swing arm, when in the first position, controls the air-supply clutch to transmit a drive force of the power shaft to the air supply device, or, the swing arm, when in the second position, controls the air-supply clutch to stop transmitting the drive force of the power shaft to the air supply device.

Preferably, the pipe-moving frame of the pipe-moving device includes a first wall, a second wall, and a lateral wall between the first and second walls, the connecting pipe is inserted through the first and second walls and provided with a stop member which is abutted against an abutting member to elastically push the connecting pipes toward the connecting pipe, the stop member is a flexible clasp;

a frame-sliding member is fixed to the base, on the first wall of the pipe-moving frame is defined an inserting hole for insertion of the frame-sliding rod, and the pipe-moving frame is slidably mounted on the frame-sliding rod, on the frame-sliding rod is sleeved a frame-abutting member pressed against the first wall of the pipe-moving frame to push the pipe-moving frame toward the guiding pipe;

the lateral wall of the pipe-moving frame is also provided with an extension portion which is inserted through a first restricting hole of a restricting portion of the base;

the main guiding member is provided with a folded end located corresponding to the first wall of the pipe-moving frame, the folded end is formed with an inserting hole for insertion of the frame-sliding rod and extends between the pipe-moving frame and the frame-sliding member, the pipe-moving frame is elastically pushed by the frame-abutting member against the folded end of the main guiding member, a pulling portion extends from the main guiding member for allowing the user to pull the main guiding member, and the main guiding member has a rear end extending through an elongated second restricting hole of the restricting portion, so as to drive the swing arm to move, and to the bottom of the main guiding member is fixed a positioning device which can produce a locking action in the first and second positions.

Preferably, the positioning device includes an elastic member and a positioning member, the elastic member is an elastic piece which is provided with a directional portion folded toward and inserted through the main guiding member, the elastic member is fixed to the main guiding member by a bolt, the elastic member is provided with an elastic portion which is folded toward the positioning member, and at the end of the elastic portion is formed an engaging portion, the positioning member is provided with a first positioning portion and a second positioning portion for engaging with the engaging portion in the first and second positions.

Preferably, the directional positioning device further includes a restricting member which is an L-shaped plate with a horizontal portion and a perpendicular potion, the horizontal portion has a free end pivoted to the lateral wall of the pipe-moving frame by a pivot, the perpendicular portion is folded to form a cover portion which is slidably mounted on the top edge of the extension portion of the pipe-moving frame, the lower end of the cover portion is formed with an upward hooking portion for hooking one end of a first return member, providing a force for enabling the restricting member to rotate with respect to the pivot and pushing the cover portion toward the pipe-moving frame, the restricting member is provided with a first positioning portion which is located on the horizontal portion, and a second positioning portion which is located at the middle section of the horizontal portion;

a second return member is hooked to the abutting end to push the stop end toward the rotation stopping member;

the rotation-stopping slot is formed in an outer peripheral edge of the rotation-stopping member for engaging with or disengaging from the stop end to stop or unstop the rotation of the main shaft, when the pipe-moving frame moves to the first or second position, the abutting end will be stopped by the first or second positioning portion.

Preferably, the main guiding member drives the swing arm to move by using a connecting rod assembly which includes a first connecting rod pivoted to the main guiding member, a second connecting rod pivoted to the first connecting rod, a first rotary shaft fixed to and rotated by the second connecting rod, a third connecting rod fixed to and rotated by the first rotary shaft, a top shaft fixed to a free end of the third connecting rod, a fourth connecting rod pushed to move by the top shaft, and a second rotary shaft with one end fixed to the fourth connecting rod and another end fixed to the swing arm, the first and second rotary shafts are pivoted to the base, the swing arm is provided at a free end thereof with a hook portion for hooking an arm-pulling member with another end hooked to the base, so as to elastically push the swing arm toward the air-supply clutch, at the free end of the swing arm is further provided a wheel located toward the air-supply clutch.

Preferably, the air-supply clutch is disposed on the power shaft of the drive force source, the free end of the power shaft is provided with a first pulley which is drivingly connected to a second pulley disposed on the main shaft by a belt, the first pulley is provided on a face thereof toward the air-supply clutch with a plurality of teeth, the air-supply clutch includes a disc-shaped clutch member, an arm-driving member used in combination with the clutch member to drive a sway arm, a pivot seat pivoted to the arm-driving member, and a spring sleeved onto the power shaft to push the clutch member toward the first pulley, the clutch member is formed with a central pipe for insertion of the power shaft, and two opposite pin-inserting portions in the form of a slot located around the central pipe, the power shaft is provided with a drive hole running through a central axis of the power shaft, and a drive pin is inserted through the drive hole and into the pin-inserting portions of the clutch member;

the clutch member is provided on a surface with a pulley-engaging portion for engaging with the teeth of the first pulley, the wheel of the swing arm is pressed against an outer peripheral portion of a surface of the clutch member where the engaging portion is formed, around the peripheral portion of another surface of the clutch member are formed plural protrusions located toward the arm-driving member, the arm-driving member is provided on a surface with a plurality of cavities for engaging with the protrusions;

the arm-driving member is provided with a central pivot portion with a small axial hole, and an eccentric drive portion formed around the outer diameter of the central pivot portion, the eccentric drive portion is inserted through and driven to rotate by the sway arm;

the pivot seat is provided with an engaging portion and fixed to the base, the arm-driving member is pivotally sleeved onto the central protruding engaging portion, the spring is disposed in a central hollow portion of the pivot seat and has one end pushed against a limiting member on the power shaft and another end pushing toward the first pulley.

Preferably, the air supply device includes an air supply source and a swing rod which drives the air supply source to supply air, the swing rod is driven by the power shaft of the drive force source and consequently drives the air supply source, the air supply source is a diaphragm air cylinder with a cylinder head and an air pipe on the cylinder head, the cylinder head is disposed on a cylinder block to clamp a diaphragm which includes a cylinder rod pivoted to a free end of the swing rod, another end of the swing rod is pivoted to the base 10, and a middle section of the swing rod is pivoted to and driven to move by the free end of the sway arm, and the air supply device further includes a one-way air feeding device.

Preferably, the connecting rod assembly is provided with a first switch which is pressed by the swing arm, when the swing arm is disconnected from the air-supply clutch, so as to close a control circuit for controlling the drive force source, the control circuit used in combination with a foot controller, the control circuit comprises: a power source connected to the foot controller, the foot controller is connected to one end of a master switch, another end of the master switch is connected to a housing safety switch and the first switch, the first switch is then serially connected to the drive force source, an NC terminal and an NO terminal of the housing safety switch are connected to an NO terminal and an NC terminal of the first switch, respectively, the NO terminal of the housing safety switch is connected to the NC terminal of the first switch to form a first circuit, and another circuit is a second circuit, the drive force source is further serially connected with a second manual switch, and a lamp is serially connected to a circuit of the master switch.

DETAILED DESCRIPTION OF THE PREFERRED EMBODIMENTS

Figure 1:
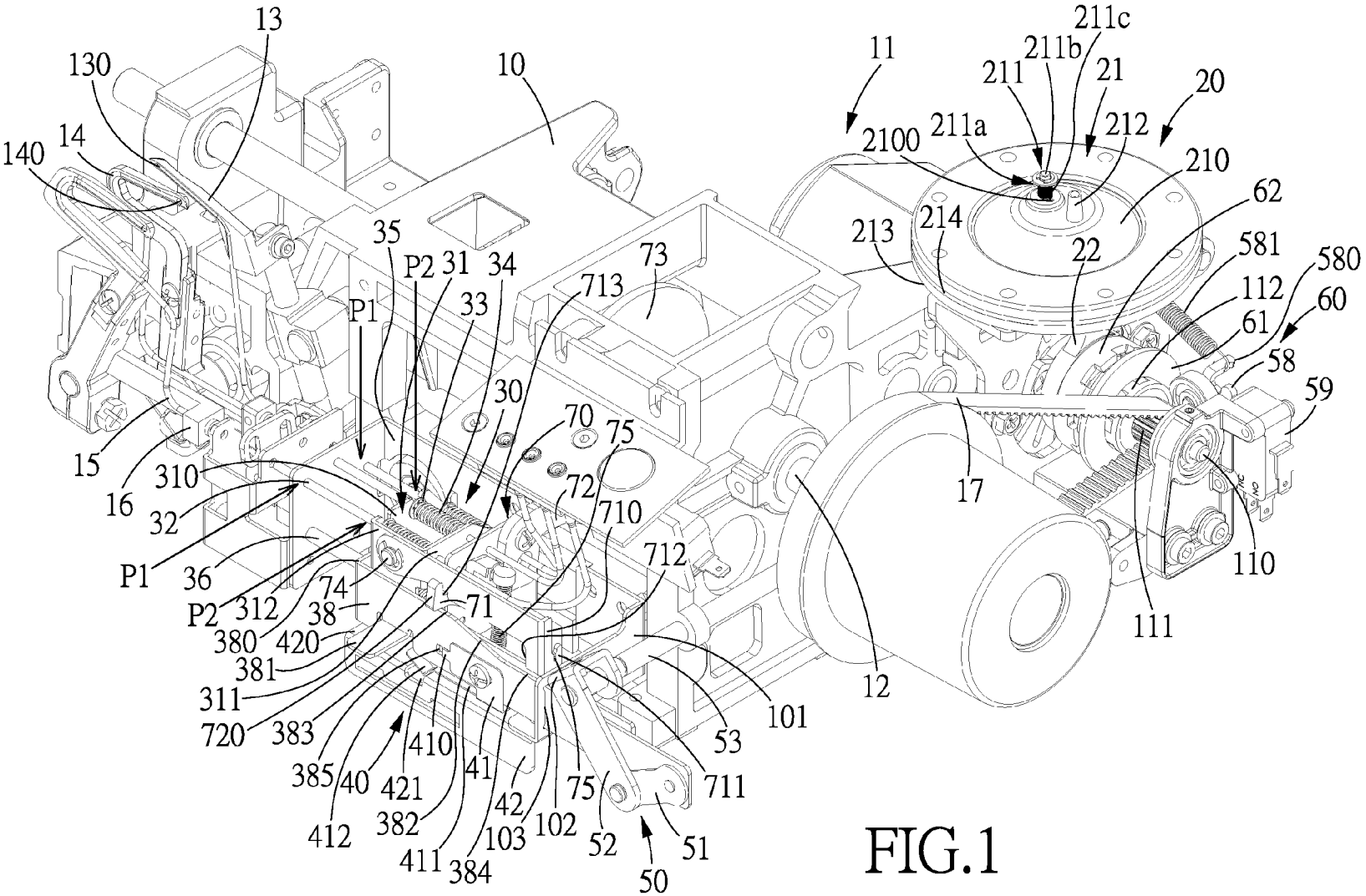
FIG. 1 is an assembly view of a part of a sewing machine with a threading and air supply selecting device in accordance with an embodiment of the present invention.

The present invention will be clearer from the following description when viewed together with the accompanying drawings, which show, for purpose of illustrations only, the preferred embodiment in accordance with the present invention.

Referring to FIGS. 1-6, a sewing machine with a threading and air supply selecting device in accordance with an embodiment of the present invention comprises: a base 10, a drive force source 11, a main shaft 12 driven by the drive force source 11, at least one thread wiper driven by the main shaft 12, and a plurality of guiding pipes 15 provided on the thread wiper. The at least one thread wiper can be an upper thread wiper 13 or a combination of an upper thread wiper 13 and at least one lower thread wiper 14. In this embodiment, there are two lower thread wipers 14, each of the guiding pipes 15 has one end extended to a thread-inserting hole 130, 140 of the upper and lower thread wipers 13, 14, and another end fixed to a pipe-guiding frame 16 of the upper and lower thread wipers 13, 14. The drive force source 11 also drives an air supply device 20, between the air supply device 20 and the pipe-guiding frames 16 is disposed a pipe-moving device 30 which includes a pipe-moving frame 31 and a plurality of connecting pipes 32 mounted on the pipe-moving frame 31, and the number of the connecting pipes 32 is the same as that of the guiding pipes 15. The pipe-moving frame 31 is provided at one end thereof with a main guiding member 38. a position where the main guiding member 38 moves to a connection between the connecting pipes 32 and the guiding pipes 15 is defined as a first position P1, and a position where the main guiding member 38 moves away from the connection between the connecting pipes 32 and the guiding pipes 15 is defined as a second position P2.

The main guiding member 38 has one end connected to one end of a swing arm 58 via a connecting rod assembly 50, and at two sides of another end of the swing arm 58 are disposed an air-supply clutch 60 and a first switch 59. The air-supply clutch 60 is disposed on a power shaft 110 of the drive force source 11, so that the swing arm 58, when in the first position P1, is abutted against the air-supply clutch 60. Or, the swing arm 58, when in the second position P2, is pushed against the first switch 59 and drives an air supply source 21 by being drivingly connected to a swing rod 23, or when in the second position P2, the swing arm 58 is disconnected from and unable to move the swing rod 23, and the first switch 59 is assuredly pushed to switch between different modes of controlling the drive force source 11.

The air supply device 20 includes the air supply source 21 and the swing rod 23 which drives the air supply source 21 to supply air. The swing rod 23 is eccentrically driven by the power shaft 110 of the drive force source 11 and consequently drives the air supply source 21. When in the first position P1, the swing rod 23 is drivingly connected to the air-supply clutch 60, so that the swing rod 23 can be eccentrically driven by the power shaft 110 to drive the air supply source 21. Or, the swing rod 23, when in the second position P2, is disconnected from the air-supply clutch 60, so that the power shaft 110 is unable to drive the swing rod 23, and the first switch 59 is not pushed or pressed.

Figure 2:
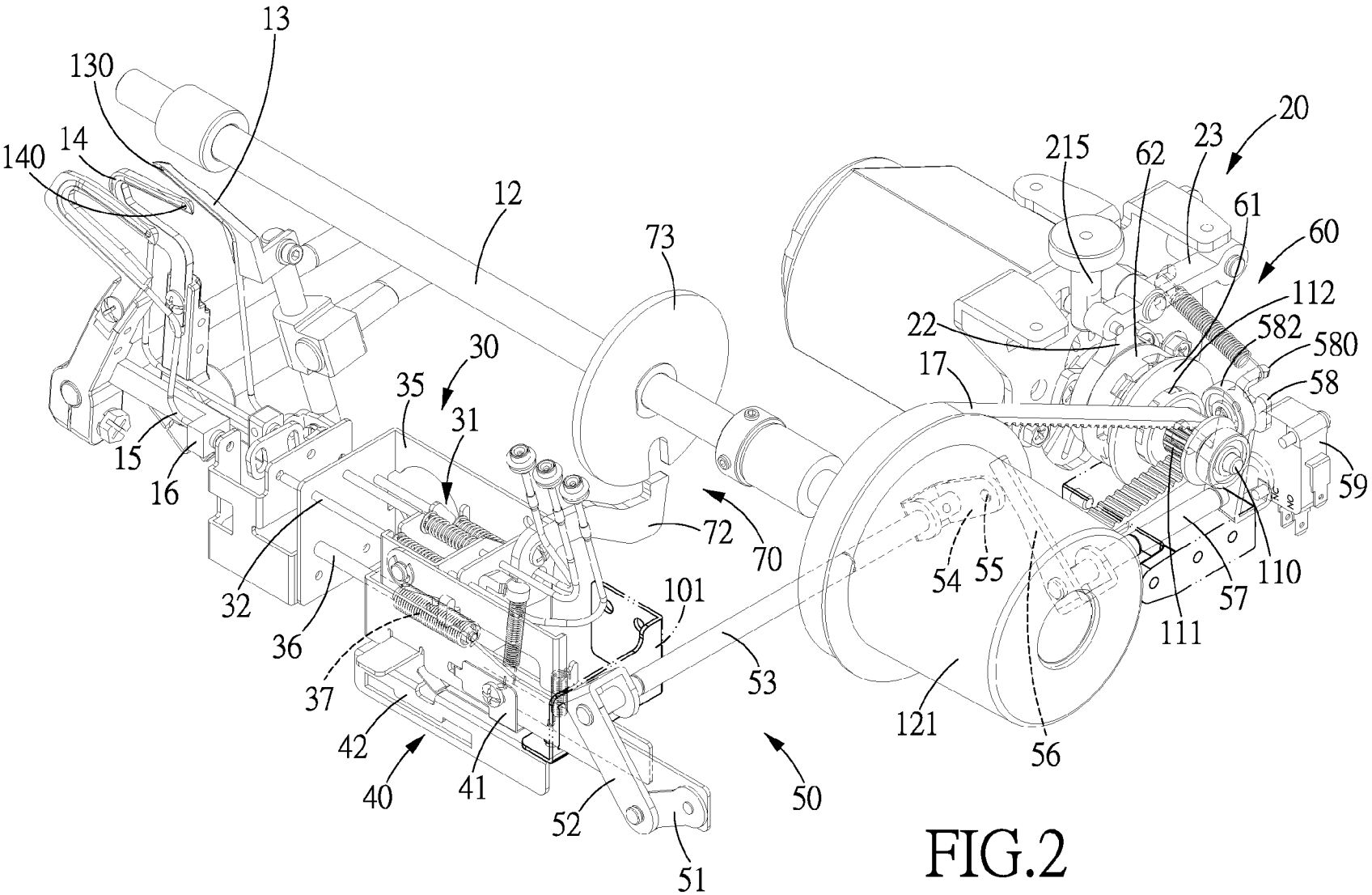
FIG. 2 is an assembly view of a part of the sewing machine with a threading and air supply selecting device in accordance with the present invention, wherein the base of the sewing machine is not shown.
Figure 3:
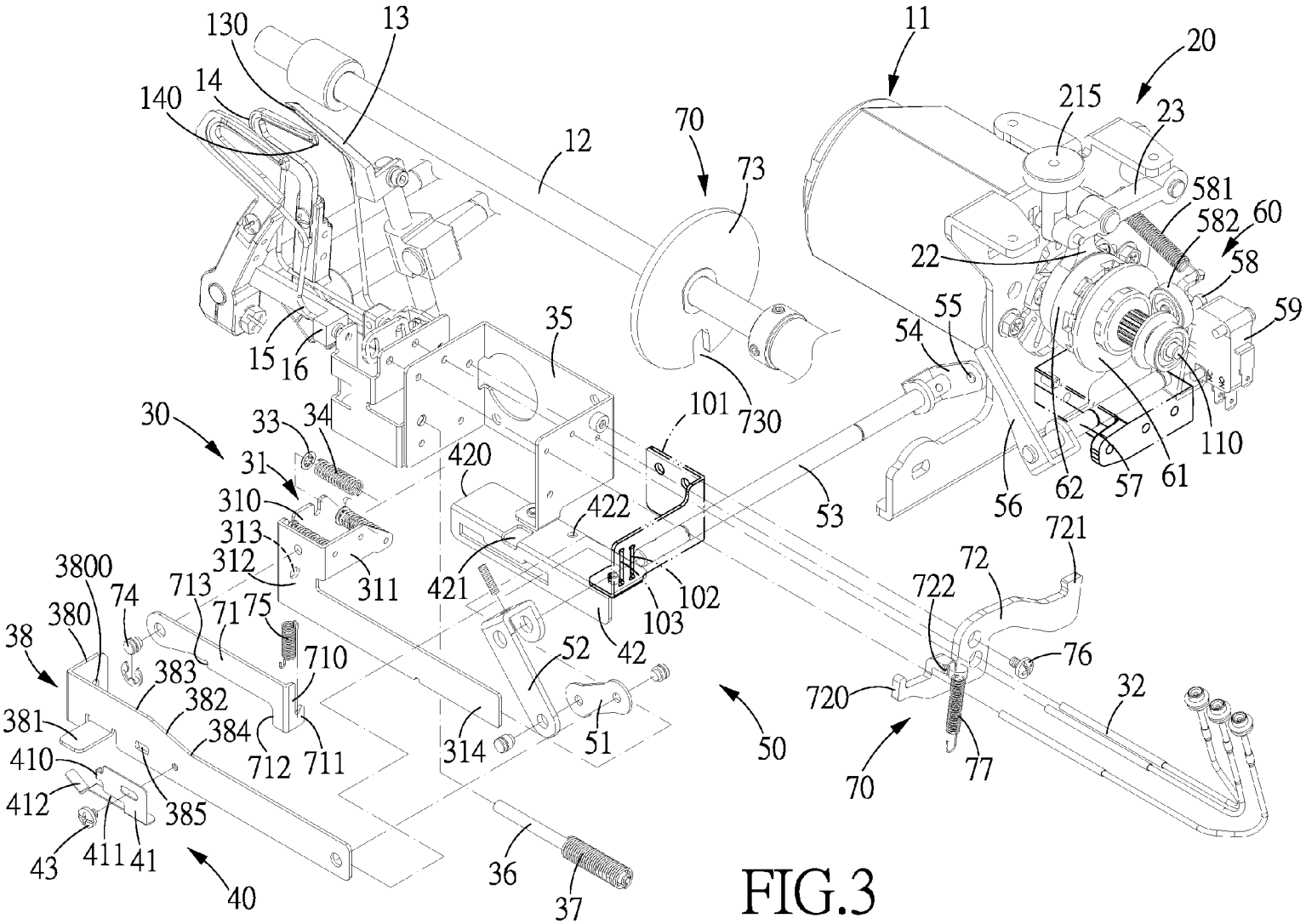
FIG. 3 is an exploded view of FIG. 2.

Referring then to FIGS. 1-3, the pipe-moving frame 31 of the pipe-moving device 30 is an U-shaped plate with a first wall 310, a second wall 311 which is parallel to the first wall 310, and a lateral wall 312 between the first and second walls 310, 311. Each of the connecting pipes 32 is inserted through the first and second walls 310, 311 and provided with a stop member 33 which is abutted against the first wall 310. An abutting member 34 in the form of a spring is sleeved on each of the connecting pipes 32, and has two ends pushed against the stop member 33 and the second wall 311 of the pipe-moving frame 31, respectively, so that the connecting pipes 32 are elastically pushed toward the guiding pipes 15. The stop member 33 is a flexible clasp.

A frame-sliding member 35 is fixed to the front end surface of the base 10 and is a U-shaped plate with two parallel end walls. Between the two end walls of the frame-sliding member 35 is disposed a frame-sliding rod 36 which is parallel to the connecting pipes 32. On the first wall 310 of the pipe-moving frame 31 is defined an inserting hole 313 for insertion of the frame-sliding rod 36, and the pipe-moving frame 31 is slidably mounted on the frame-sliding rod 36. On the frame-sliding rod 36 is sleeved a frame-abutting member 37 in the form of a spring with two ends pressed against the first wall 310 of the pipe-moving frame 31 and one end surface of the frame-sliding member 35, respectively, so that the pipe-moving frame 31 is elastically pushed toward the guiding pipes 15.

The lateral wall 312 of the pipe-moving frame 31 is also provided with an extension portion 314 which is inserted through a first restricting hole 102 of a restricting portion 101 of the base 10, so that the pipe-moving frame 31 is able to move while supporting the connecting pipes 32 in a position where the connecting pipes 32 are aligned with the guiding pipes 15.

The main guiding member 38 is provided with a folded end 380 located corresponding to the first wall 310 of the pipe-moving frame 31. The folded end 380 is formed with an inserting hole 3800 for insertion of the frame-sliding rod 36, extends between the pipe-moving frame 31 and the frame-sliding member 35, and is flatly abutted against the first wall 310 of the pipe-moving frame 31. The pipe-moving frame 31 is elastically pushed by the frame-abutting member 37 against the folded end 380 and driven to move by the folded end 380 of the main guiding member 38. A pulling portion 381 horizontally extends from the bottom of the front end surface of the main guiding member 38 for allowing the user to pull the main guiding member 38. The main guiding member 38 has a rear end extending through an elongated second restricting hole 103 of the restricting portion 101, so as to drive the swing arm 58 to move. To the bottom of the main guiding member 38 is fixed a positioning device 40.

The positioning device 40 includes an elastic member 41 and a positioning member 42. The elastic member 41 is an elastic piece with one end flatly abutted against the surface of the main guiding member 38 and is provided with a directional portion 410 folded toward and inserted through the main guiding member 38. The elastic member 41 is movably fixed to the main guiding member 38 by a bolt 43 inserted through an elongated hole formed in the elastic member 41. The elastic member 41 is provided with an elastic portion 411 which is folded toward the positioning member 42, and at the end of the elastic portion 411 is formed a V-shaped engaging portion 412. The positioning member 42 is provided with a first positioning portion 420 and a second positioning portion 421 located corresponding to the first and second positions P1, P2, respectively, so that the main guiding member 38 can be positioned to the first and second positions P1, P2 by the engaging portion 412, and can move the pipe-moving frame 31 to the first and second positions P1, P2.

Figure 4:
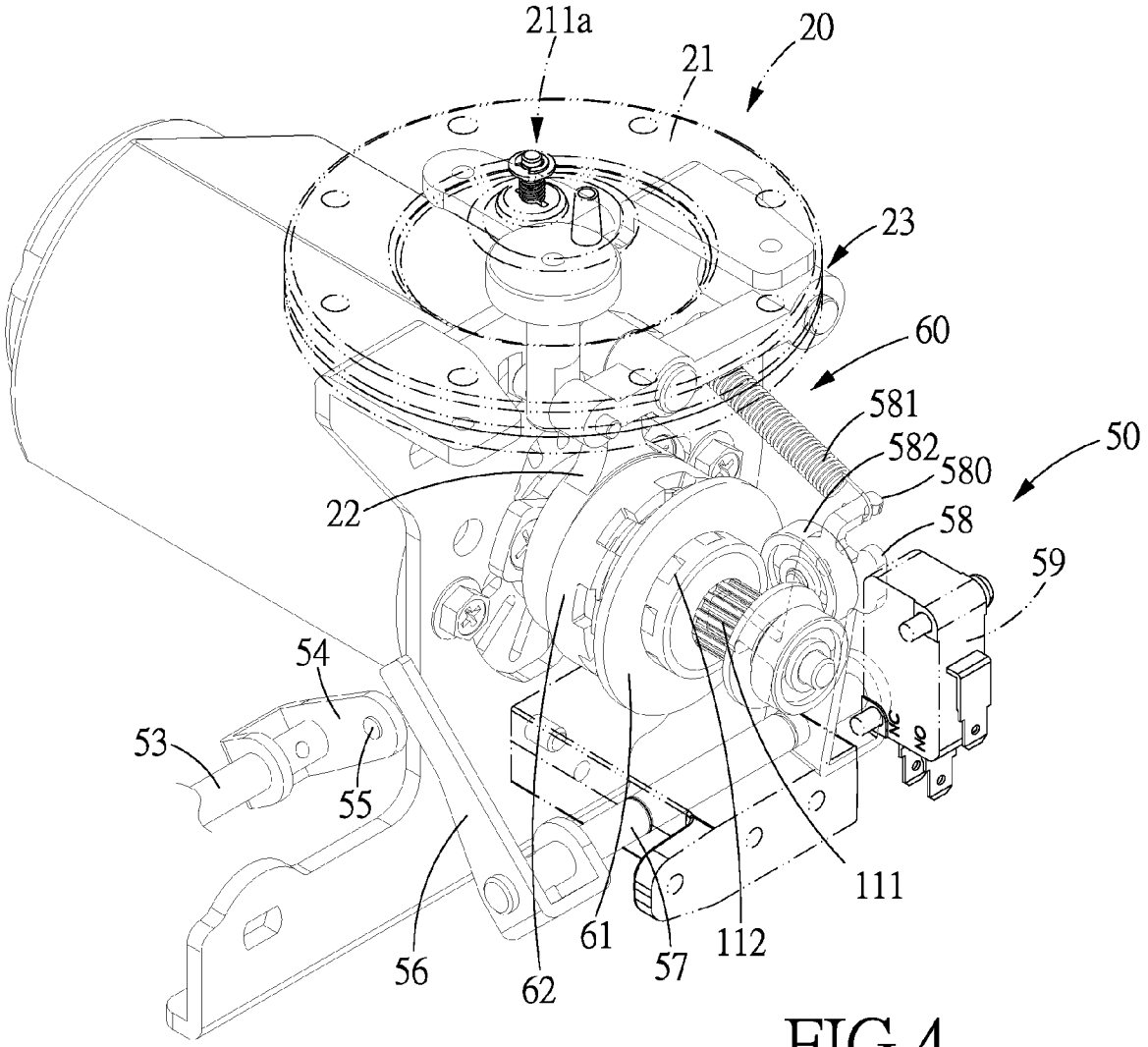
FIG. 4 is a perspective view of the connecting rod assembly and the air-supply clutch of the sewing machine sewing machine with a threading and air supply selecting device in accordance with the present invention.
Figure 5:
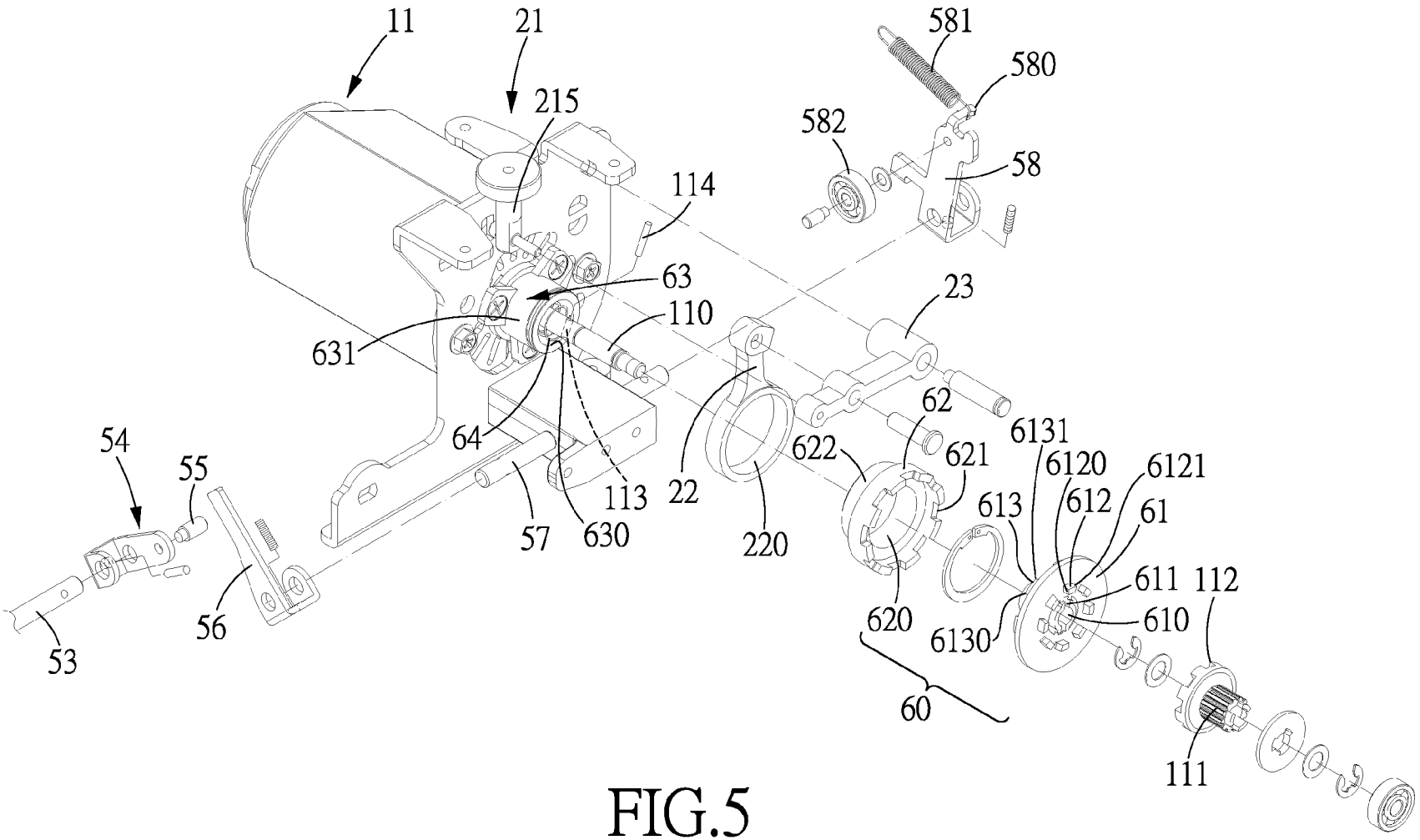
FIG. 5 is an exploded view of FIG. 4.

The main guiding member 38 drives the swing arm 58 to move by using the connecting rod assembly 50, as shown in FIGS. 4 and 5, the connecting rod assembly 50 includes a first connecting rod 51 pivoted to the main guiding member 38, a second connecting rod 52 pivoted to the first connecting rod 51, a first rotary shaft 53 fixed to and rotated by the second connecting rod 52, a third connecting rod 54 fixed to and rotated by the first rotary shaft 53, a top shaft 55 fixed and perpendicular to a free end of the third connecting rod 54, a fourth connecting rod 56 pushed to move by the top shaft 55, and a second rotary shaft 57 with one end fixed to the fourth connecting rod 56 and another end fixed to the swing arm 58. The first and second rotary shafts 53, 57 are pivoted to the base 10, and each of the connecting rods 51, 52, 54, and 56 is a plate. The second connecting rod 52 and the third connecting rod 54 are folded toward the first rotary shaft 53 into a U-shaped structure, and the fourth connecting rod 56 and the swing arm 58 are also folded toward the end of the second rotary shaft 57 into a U-shaped structure. The connecting rods 51, 52, 54, and 56 are fixed to the rotary shafts 53, 57 by bolts. The swing arm 58 is provided at a free end thereof with a hook portion 580 for hooking an arm-pulling member 581 which is in the form of a spring with another end hooked to the base 10, so as to elastically push the swing arm 58 toward the air-supply clutch 60. At the free end of the swing arm 58 is further provided a wheel 582 located toward the air-supply clutch 60 to reduce friction loss.

Figure 6:
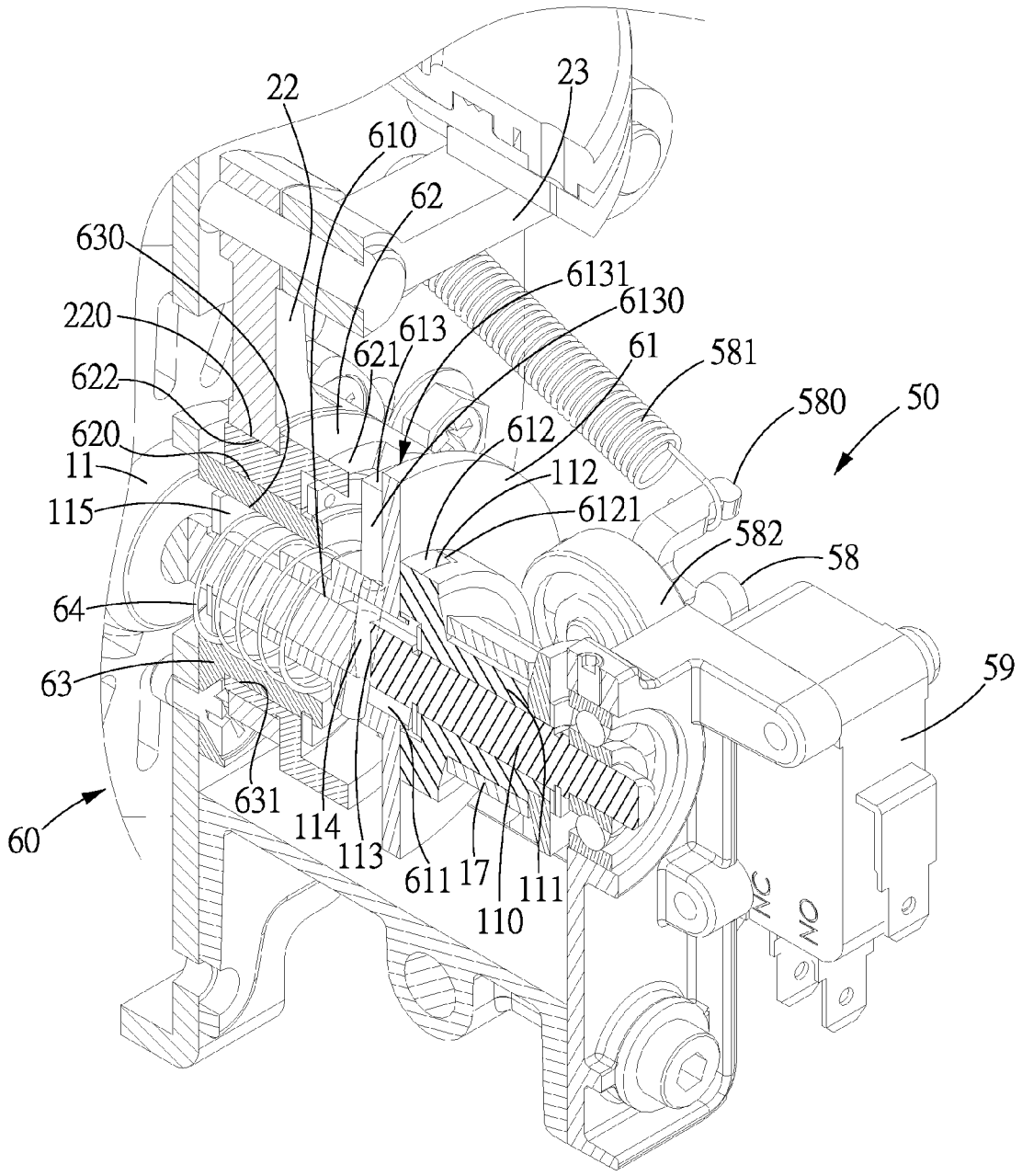
FIG. 6 is a cross sectional view of the assembly of the drive force source and the air-supply clutch of the sewing machine with a threading and air supply selecting device in accordance with the present invention.

Referring then to FIG. 6, the air-supply clutch 60 is disposed on the power shaft 110 of the drive force source 11, the free end of the power shaft 110 is provided with a first pulley 111 which is drivingly connected to a second pulley 121 disposed on the main shaft 12 by a belt 17. The first pulley 111 is provided on a face thereof toward the air-supply clutch 60 with a plurality of teeth 112. The air-supply clutch 60 includes a disc-shaped clutch member 61, an arm-driving member 62 used in combination with the clutch member 61 to drive a sway arm 22, a pivot seat 63 pivoted to the arm-driving member 62, and a spring 64 sleeved onto the power shaft 110 to push the clutch member 61 toward the first pulley 111. The clutch member 61 is formed with a central pipe 610 for insertion of the power shaft 110, and two opposite pin-inserting portions 611 in the form of a slot located around the central pipe 610. The power shaft 110 is provided with a drive hole 113 running through the central axis of the power shaft 110, and a drive pin 114 is inserted through the drive hole 113 and into the pin-inserting portions 611 of the clutch member 61, so that the power shaft 110 can use the drive pin 114 to drive the clutch member 61 to rotate, and the clutch member 61 is able to move along the power shaft 110.

The clutch member 61 is provided on a surface with a pulley-engaging portion 612 in the form of a plurality of teeth for engaging with the teeth 112 of the first pulley 111, and each of the teeth of the pulley-engaging portion 612 has a drive surface 6120 perpendicular to the clutch member 61, and an opposite slanting guiding surface 6121. With the slanting guiding surface 6121, the pulley-engaging portion 612 can be easily and smoothly guided into the teeth 112, so as to facilitate engagement of the clutch member 61 with the power shaft 110. The wheel 582 of the swing arm 58 is pressed against the outer peripheral portion of the surface of the clutch member 61 where the pulley-engaging portion 612 is formed. Around the peripheral portion of another surface of the clutch member 61 are formed plural protrusions 613 located toward the arm-driving member 62. The arm-driving member 62 is provided on a surface with a plurality of cavities 621 for engaging with the protrusions 613. Each of the protrusions 613 has a drive surface 6130 perpendicular to the clutch member 61, and an opposite slanting guiding surface 6131. With the slanting guiding surface 6131, the protrusions 613 can be smoothly and easily guided into the cavities 621, making it easier for the clutch member 61 to engage with and rotate the arm-driving member 62.

The arm-driving member 62 is a stepped structure with two different diameters, and provided with a central pivot portion 620 with a small axial hole, and an eccentric drive portion 622 formed around the outer diameter of the central pivot portion 620. Namely, the eccentric drive portion 622 is not coaxial with the central pivot portion 620, and inserted through and driven to rotate by a driven portion 220 of the sway arm 22, so that the drive portion 622 moves up and down with respect to the sway arm 22.

The pivot seat 63 is a hollow disc-shaped structure with a central protruding engaging portion 631, and fixed to the base 10 by bolts. The arm-driving member 62 is pivotally sleeved onto the pivot seat 63 by inserting the central protruding engaging portion 631 through the central pivot portion 620. The spring 64 is disposed in a central hollow portion 630 of the pivot seat 63, sleeved onto the power shaft 110, and has one end pushed against a limiting member 115 on the power shaft 110 and another end pushing the clutch member 61 toward the first pulley 111.

A directional positioning device 70 cooperates with the pipe-moving frame 31 to restrict the main shaft 12 from rotating. As shown in FIGS. 2 and 3, the top edge of the main guiding member 38 is a guiding edge 382 with height difference, namely, the guiding edge 382 has a first end 383 and a second end 384 lower than the first end 383. The directional positioning device 70 includes a restricting member 71, a limiter 72, and a rotation-stopping member 73 coaxially rotating with the main shaft 12. The restricting member 71 is an L-shaped plate with a horizontal portion and a perpendicular potion. The horizontal portion has a free end pivoted to the lateral wall 312 of the pipe-moving frame 31 by a pivot 74. The perpendicular portion is folded to form a cover portion 710 which is slidably mounted on the top edge of the extension portion 314 of the pipe-moving frame 31. The lower end of the cover portion 710 is formed with an upward hooking portion 711 for hooking one end of a first return member 75 in the form of a spring, and another end of the first return member 75 is hooked to the bottom of the extension portion 314 of the pipe-moving frame 31, providing a force for enabling the restricting member 71 to rotate with respect to the pivot 74 and pushing the cover portion 710 toward the extension portion 314 of the pipe-moving frame 31. The restricting member 71 is provided with a first positioning portion 712 which is located on the horizontal portion and close to the perpendicular portion, and a second positioning portion 713 which is located at the lower edge of the middle section of the horizontal portion.

The limiter 72 is an S-shaped plate with a middle section pivoted to the wall of the frame-sliding member 35 which is perpendicular to the base 10, and has an abutting end 720 protruding upward between the restricting member 71 and the main guiding member 38, and a stop end 721 protruding upward toward the main shaft 12. A second return member 77 is hooked between the abutting end 720 and the positioning member 42 of the base 10 to push the stop end 721 toward the rotation stopping member 73. The limiter 72 is further provided with a horizontally-extending hooking portion 722 located close to the abutting end 720, and the positioning member 42 is formed with a hooking hole 422 for easy hooking of the second return member 77.

The rotation-stopping member 73 is a circular disc with a rotation-stopping slot 730 formed in an outer peripheral edge thereof for engaging with or disengaging from the stop end 721 to stop or unstop the rotation of the main shaft 12. Meanwhile, the pipe-moving frame 31 moves to the first or second position P1, P2, the abutting end 720 will be stopped by the first or second positioning portion 712, 713, so as to provide multiple locking actions.

Figure 7:
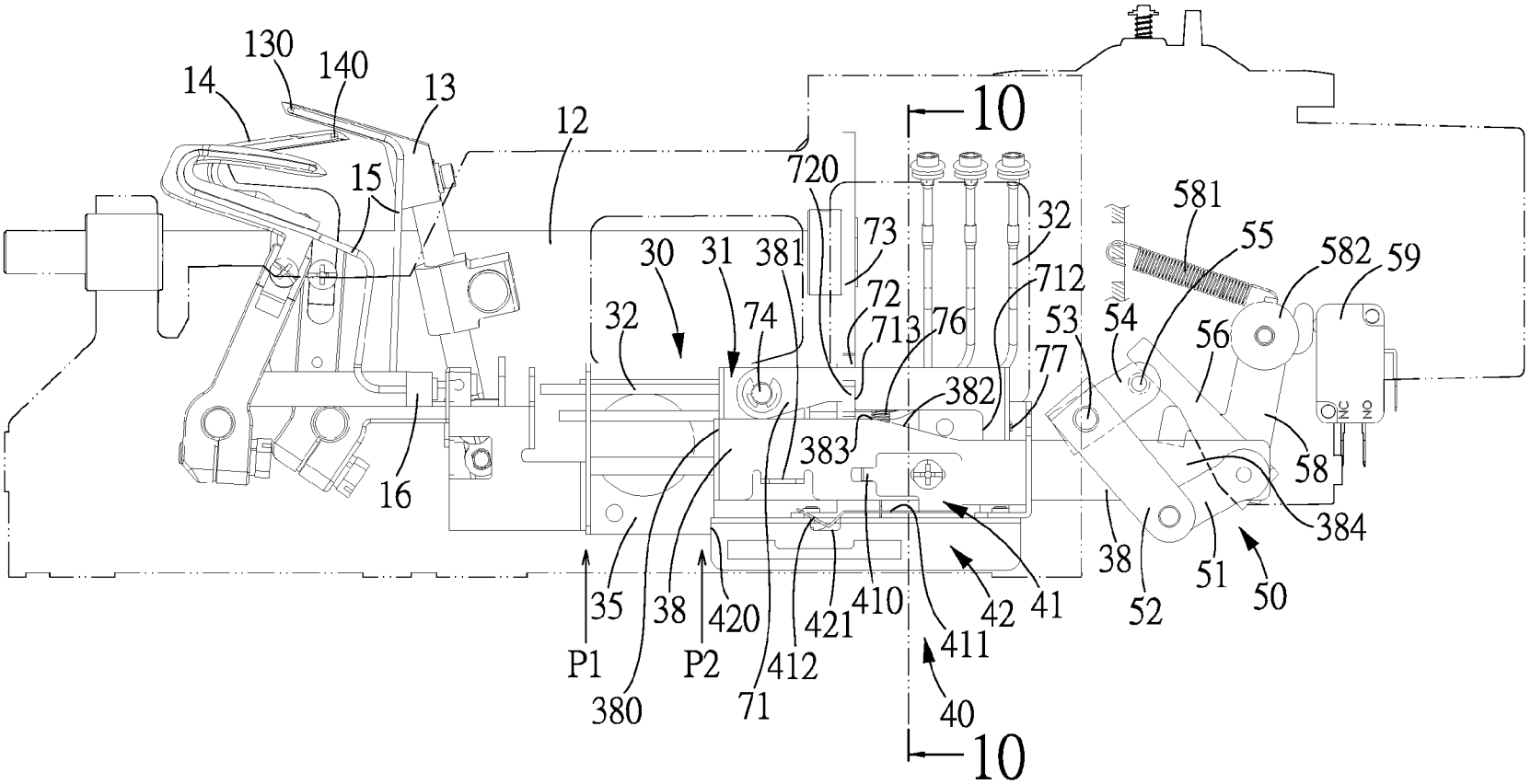
FIG. 7 is a front view showing that the pipe-moving device and the positioning device of the sewing machine with a threading and air supply selecting device in accordance with the present invention are in the second position.
Figure 8:
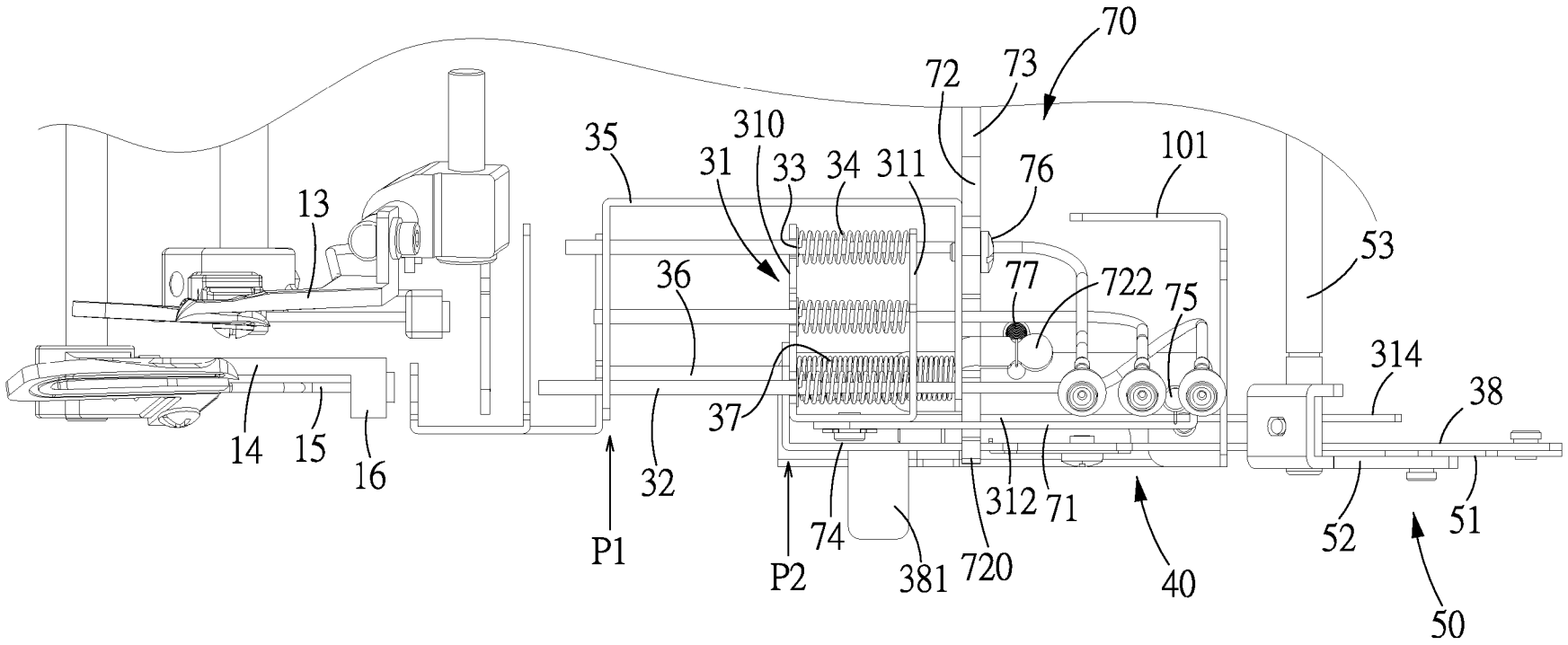
FIG. 8 is a top view of FIG. 6.
Figure 9:
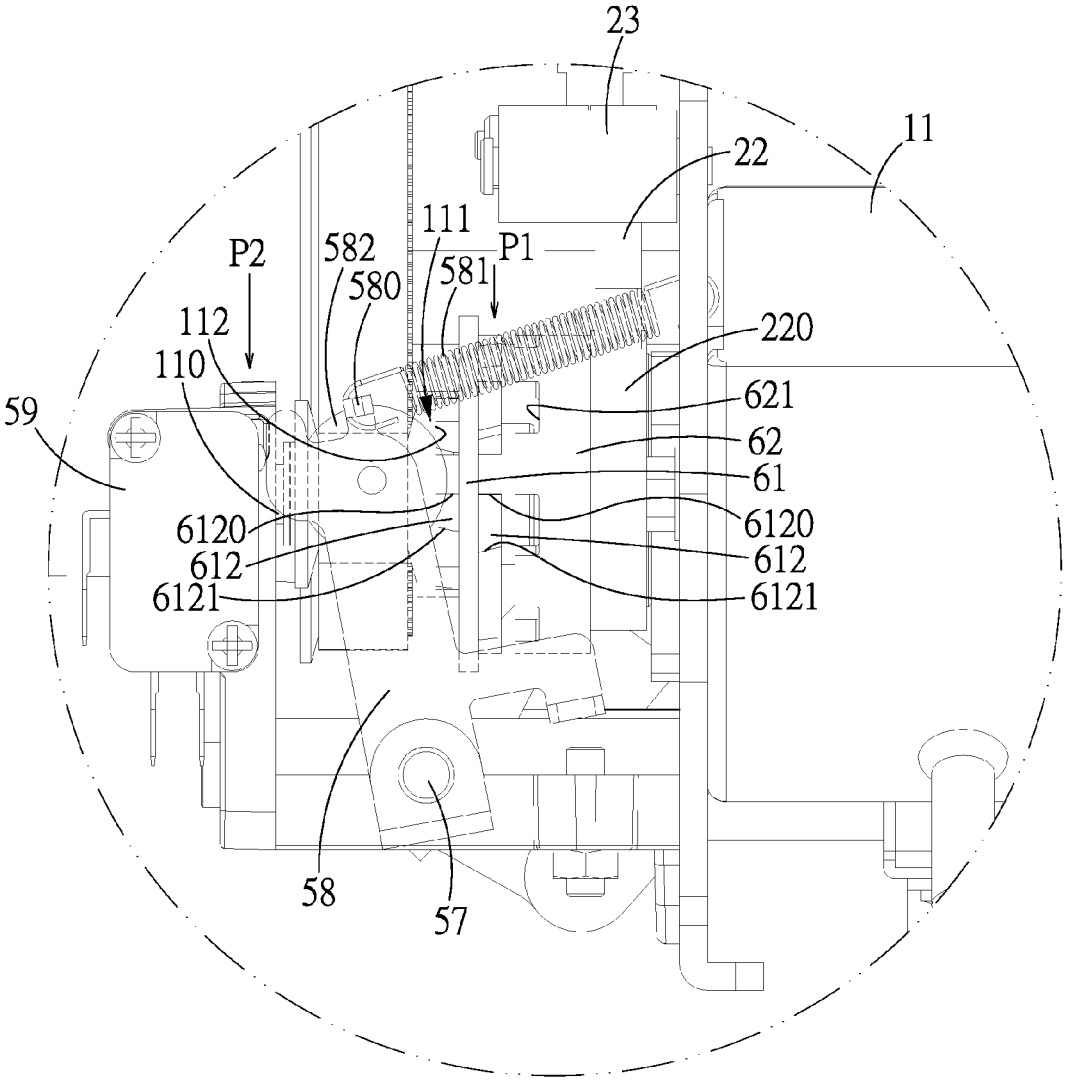
FIG. 9 shows that the air supply device of the sewing machine with a threading and air supply selecting device in accordance with the present invention is in the second position.
Figure 10:
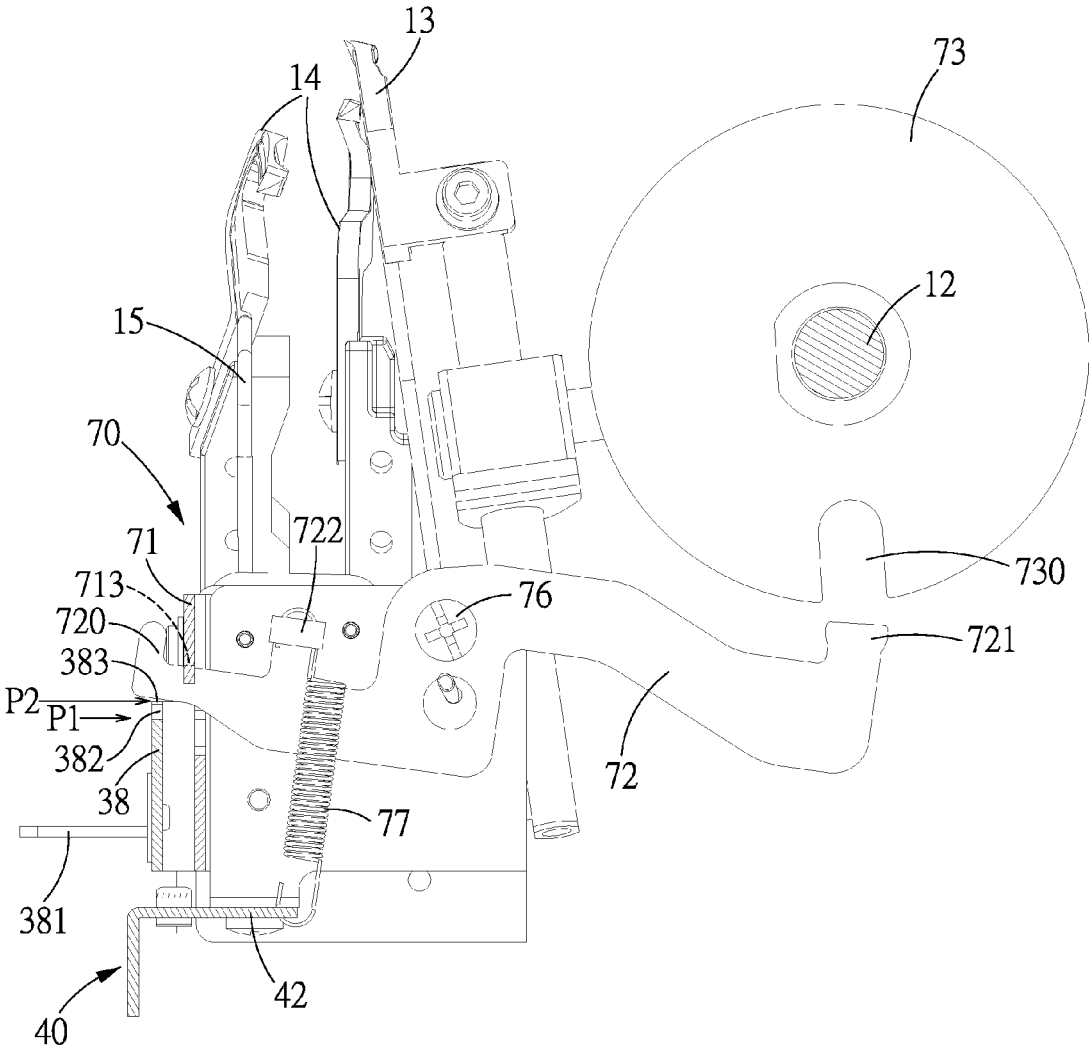
FIG. 10 shows that the directional positioning device of the sewing machine with a threading and air supply selecting device in accordance with the present invention is in the second position.

Referring then to FIGS. 7 and 8, which show the pipe-moving frame 31 in the second position P2, the pipe-moving frame 31 cooperates with the positioning device 40 to produce a locking action in the second position P2. The engaging portion 412 of the elastic member 41 is elastically engaged with the second positioning portion 421. Meanwhile, the frame-abutting member 37 is compressed, the connecting pipes 32 of the pipe-moving frame 31 disengage from the guiding pipes 15, and the main guiding member 38 drives the connecting rod assembly 50 to make the wheel 582 of the swing arm 58 move away from the clutch member 61 of the air-supply clutch 60, at the same time, another end of the swing arm 58 presses the first switch 59, so that, as shown in FIG. 9, power outputted from the drive force source 11 is transmitted to the clutch member 61 via the power shaft 110, to make the protrusions 613 engage with the teeth 112 of the first pulley 111, putting the sewing machine in a workable condition where sewing can be performed. For the directional positioning device 70, please refer to FIG. 10, the first end 383 of the guiding edge 382 of the main guiding member 38 which is higher than the second end 384 will push against the bottom of the abutting end 720 of the limiter 72 to maintain the stop end 721 in a position away from the rotation-stopping slot 730 of the rotation-stopping member 73, so that the main shaft 12 is not stopped by the rotation-stopping member 73 and can be rotated to perform sewing operations. Meanwhile, the second positioning portion 713 of the restricting member 71 is engaged with the abutting end 720 to provide a second locking action.

Figure 11:
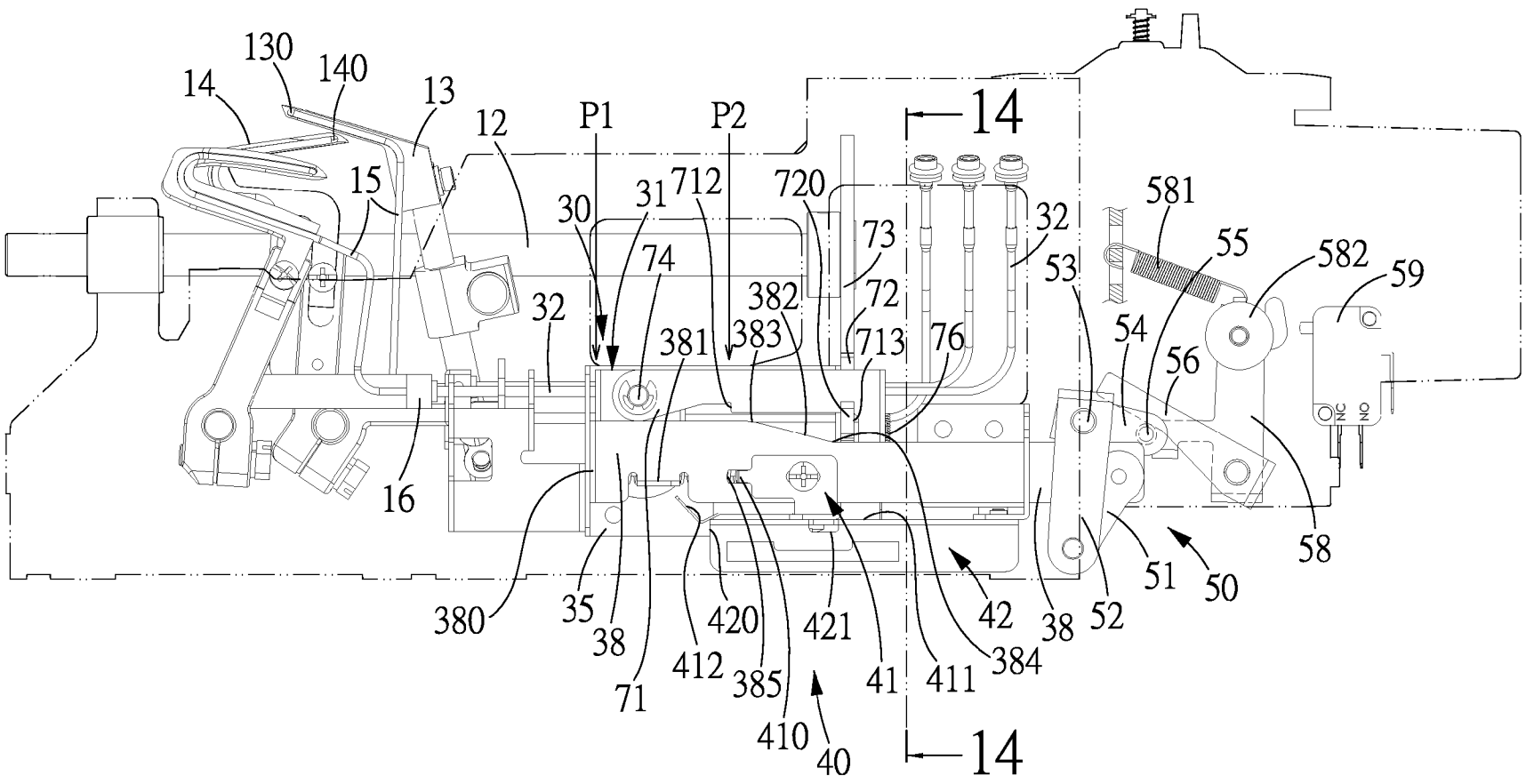
FIG. 11 is a front view showing that the pipe-moving device and the positioning device of the sewing machine with a threading and air supply selecting device in accordance with the present invention are in the first position.
Figure 12:
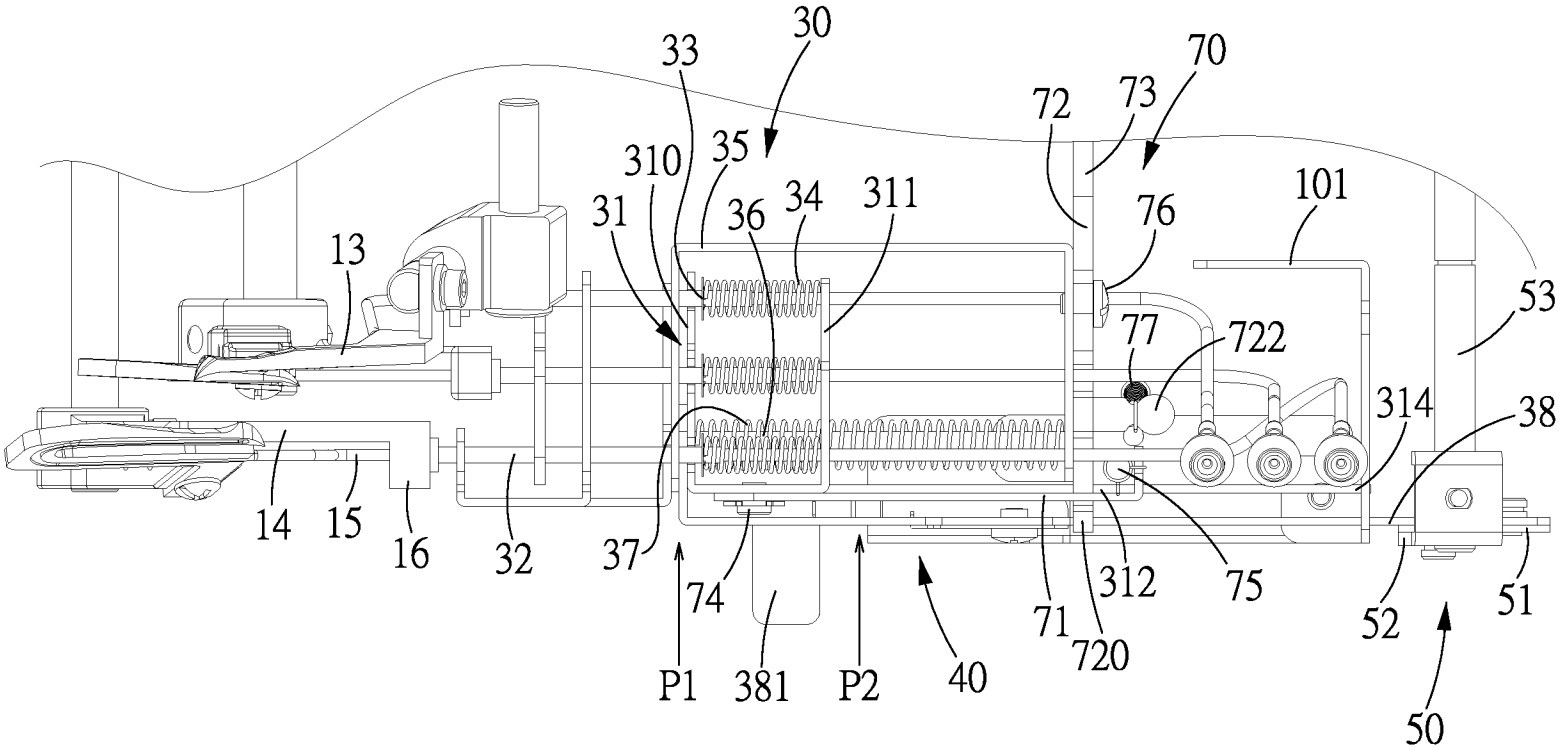
FIG. 12 is a top view of FIG. 11.

Referring then to FIGS. 11 and 12, which show the pipe-moving frame 31 of the pipe-moving device 30 in the first position P1, the pipe-moving frame 31 cooperates with the positioning device 40 to produce a locking action in the first position P1. The engaging portion 412 of the elastic member 41 is elastically engaged with the second positioning portion 421. Meanwhile, the frame-abutting member 37 pushes the pipe-moving frame 31 to slide along the frame-sliding rod 36, and the connecting pipes 32 are moved to a position where the connecting pipes 32 are connected to the guiding pipes 15. The main guiding member 38 drives the connecting rod assembly 50 to make the wheel 582 of the swing arm 58 push the clutch member 61 toward the arm-driving member 62, and another end of the swing arm 59 presses the first switch 59, so that, as shown in FIG. 9, power outputted from the drive force source 11 is transmitted to the clutch member 61 via the power shaft 110, to make the pulley-engaging portion 612 engage with the cavities 621 of the arm-driving member 62, putting the air supply device 20 into an actuated position where the power is able to drive the air supply device 20.

Figure 13:
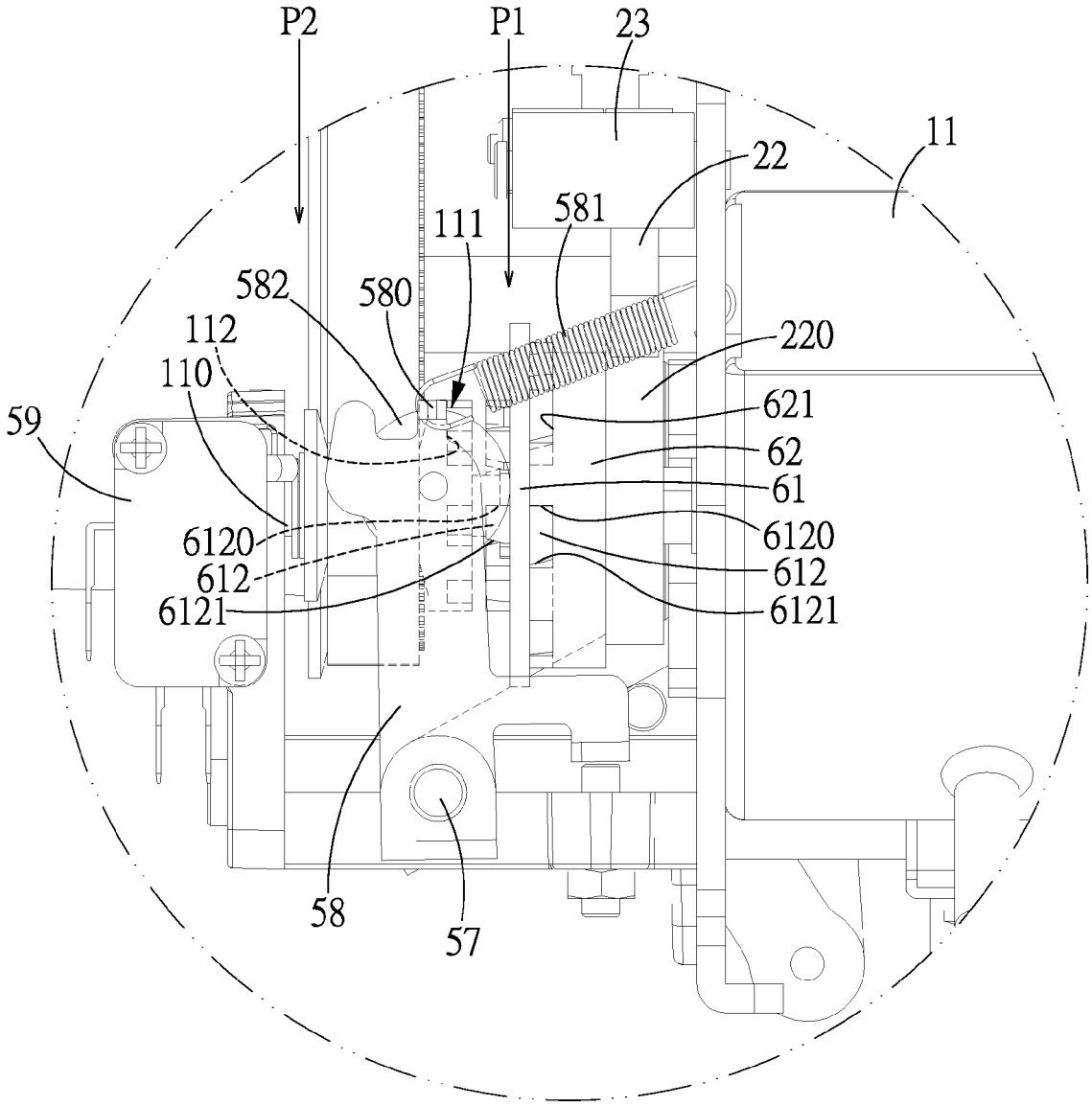
FIG. 13 shows that the air supply device of the sewing machine with a threading and air supply selecting device in accordance with the present invention is in the first position.
Figure 14:
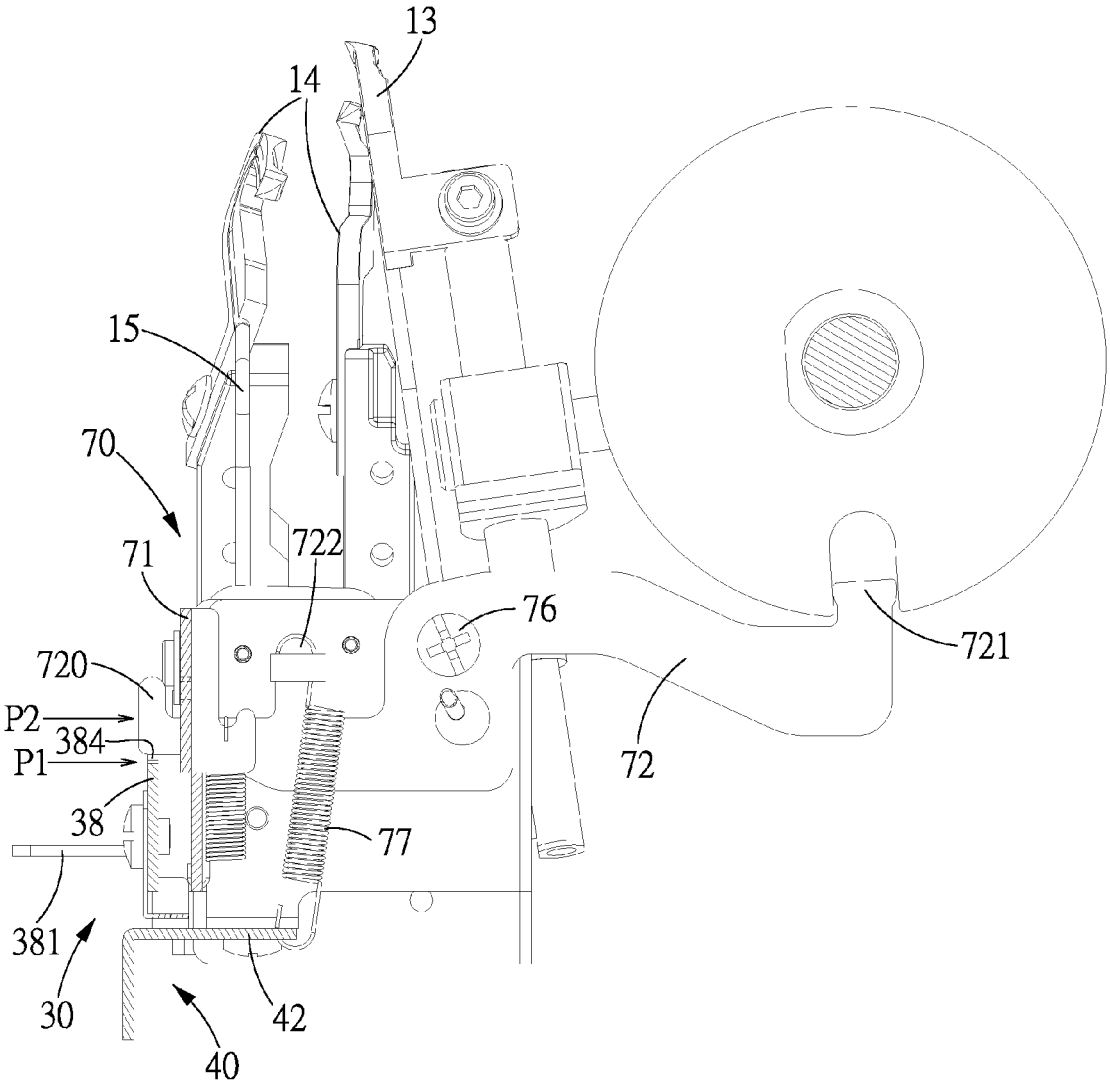
FIG. 14 shows that the directional positioning device of the sewing machine with a threading and air supply selecting device in accordance with the present invention is in the first position.

For the directional positioning device 70, please refer to FIG. 13, the second end 384 of the main guiding member 38 which is lower than the first end 383 will push against the bottom of the abutting end 720 of the limiter 72 to raise the stop end 721 to a position of being engaged with the rotation-stopping slot 730 of the rotation-stopping member 73, so that the main shaft 12 is restricted by the rotation-stopping member 73 from rotating, or restricted in the initial position., where the rotation-stopping slot 730 is not aligned with the stop end 721, and the stop end 721 is pushed by the second return member 77 against the rotation-stopping member 73. When the main shaft 12 is rotated by the user to a position where the rotation-stopping slot 730 is aligned with the stop end 721, the stop end 721 will be pushed by the second return member 77 into the rotation-stopping slot 730 to stop the main shaft 12 from rotating. The thread wipers 13, 14 are moved by the main shaft 12 back to their initial positions, where the guiding pipes 15 are located at the second end of the pipe-guiding frame 16 and able to connect to the connecting pipes 32. Meanwhile, the first positioning portion 712 of the restricting member 71 is engaged with the abutting end 720 to provide a second locking action.

Figure 15:
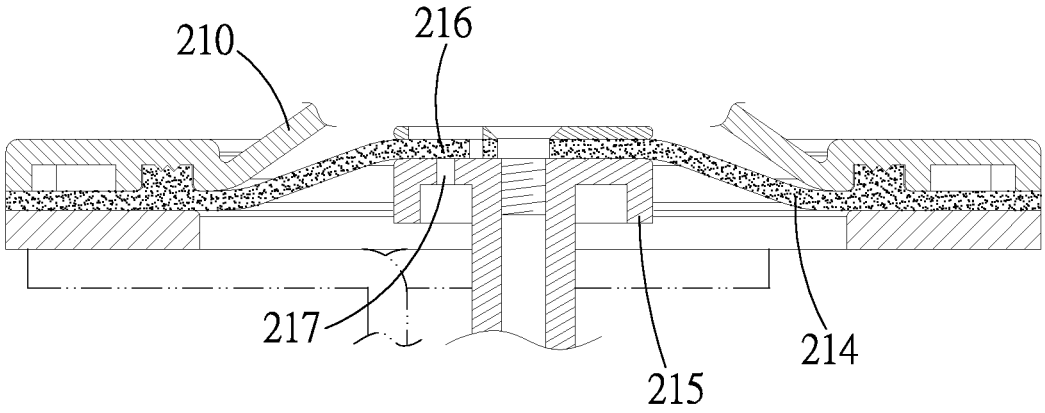
FIG. 15 is a cross sectional view of an air supply source of the sewing machine with a threading and air supply selecting device in accordance with another embodiment of the present invention.
Figure 16:
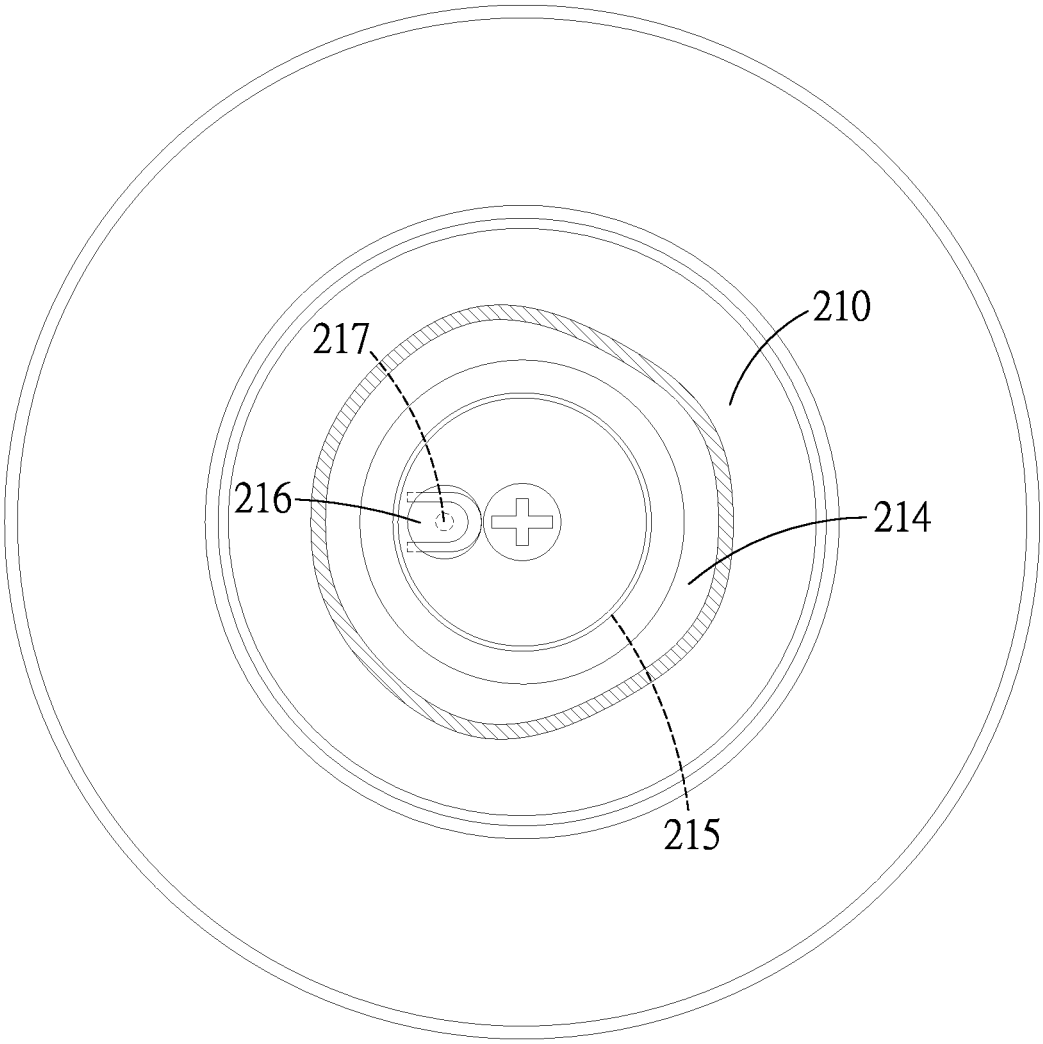
FIG. 16 is a top view of FIG. 15.
Figure 17:
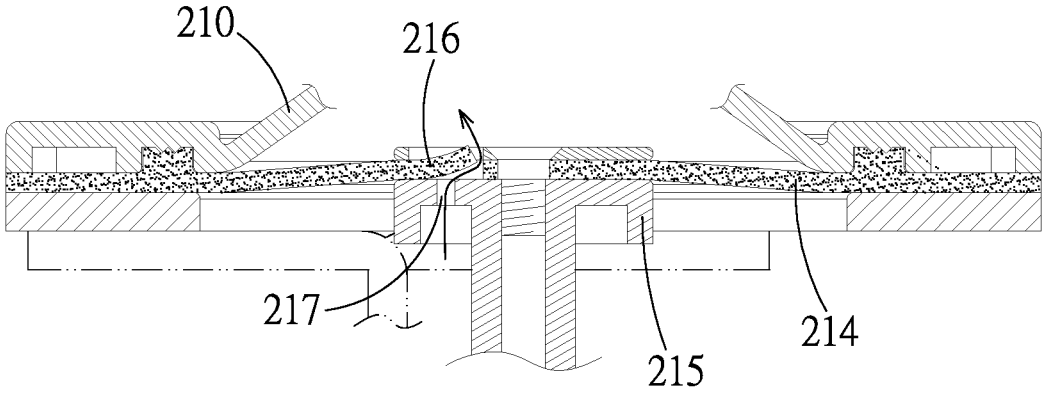
FIG. 17 is an operational view of FIG. 15.

Referring then to FIGS. 1-4, the air supply device 20 includes the air supply source 21 and the swing rod 23 which is driven by the power shaft 110 to drive the air supply source 21 to supply air. The air supply source 21 is a diaphragm air cylinder with a cylinder head 210 and an air pipe 212 on the cylinder head 210. The cylinder head 210 is disposed on a cylinder block 213 to clamp a diaphragm 214 which includes a cylinder rod 215 pivoted to a free end of the swing rod 23. Another end of the swing rod 23 is pivoted to the base 10, and a middle section of the swing rod 23 is pivoted to and driven to move by the free end of the sway arm 22. The air supply device 20 further includes a one-way air feeding device 211 which is a one-way valve 211*a* which includes a valve rod 211*b* to seal an air feeding hole 2100 formed on a top of the cylinder head 210, and a spring 211*c* for pulling the valve rod 211*b*. The one-way air feeding device 211 can also be as shown in FIGS. 15 and 16, wherein the diaphragm 214 is provided with an elastic piece 216, at the top end of the cylinder rod 215 is formed an air feeding hole 217 which is covered with the elastic piece 216. When the cylinder rod 215 is pulled down, low pressure will be created inside the air supply source 21, and outside air will be sucked into the air supply source 21 via the air feeding hole 217, as shown in FIG. 17. After that, the cylinder rod 215 will return to its original position (height) to push the air out of the air supply source 21, and the elastic piece 216 covers the air feeding hole 217 again, thus creating a one-way air feeding structure for sucking outside air into the air supply source 21 in a one way manner.

Figure 18:
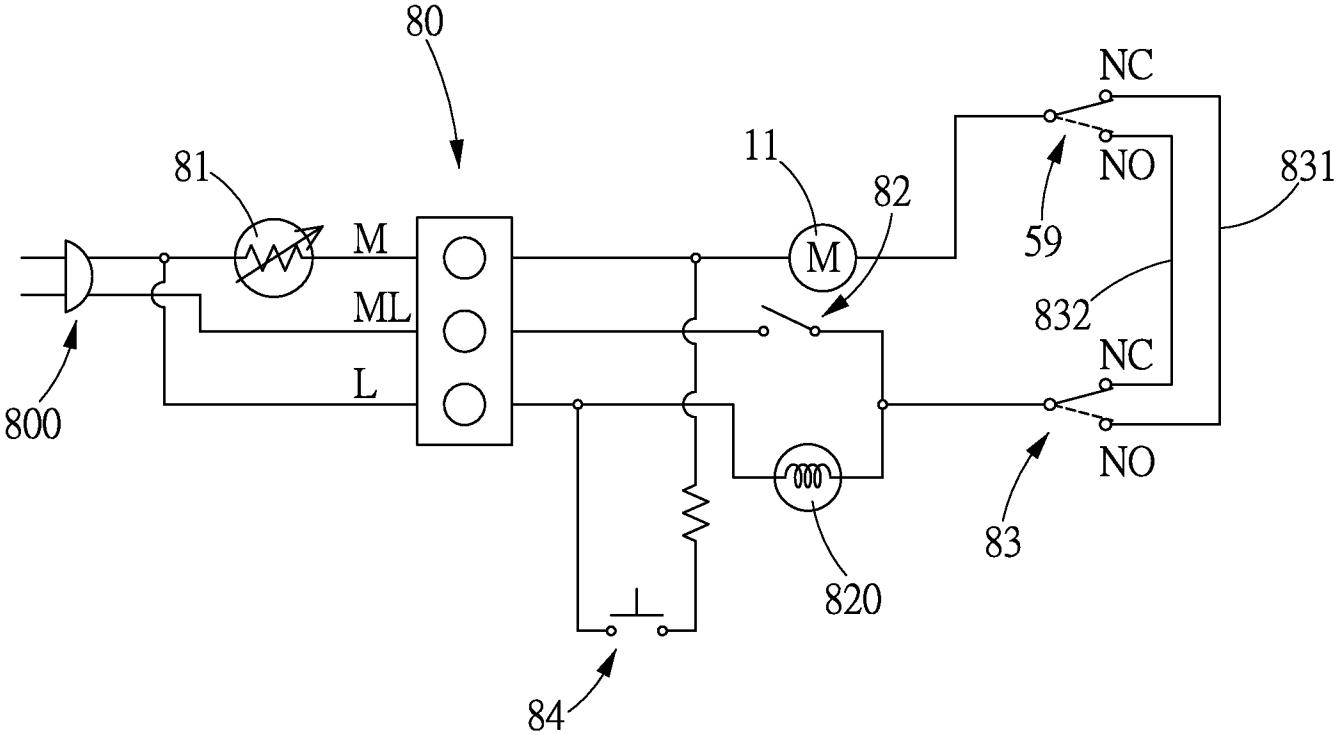
FIG. 18 is a circuit diagram of the present invention.

A control circuit 80 for being used in combination with a conventional foot controller 81 and the first switch 59 of the present invention, as shown in FIG. 18, comprises: a power source 800 connected to the foot controller 81, the foot controller 81 is connected to one end of a master switch 82, another end of the master switch 82 is connected to a housing safety switch 83 and the first switch 59. The first switch 59 is then serially connected to the drive force source 11. An NC terminal and an NO terminal of the housing safety switch 83 are connected to an NO terminal and an NC terminal of the first switch 59, respectively. The NO terminal of the housing safety switch 83 is connected to the NC terminal of the first switch 59 to form a first circuit 831, and another circuit is a second circuit 832. The drive force source 11 is further serially connected with a second manual switch 84. When in the second position P2, the swing arm 58 presses against the first switch 59, and the gate of the first switch 59 is connected to the NO terminal of the first switch 59. When the housing safety switch 83 is covered by the housing of the sewing machine, the NO terminal of the first switch 59 keeps connecting to the NC terminal of the housing safety switch 83, namely, the second circuit 832 is closed. Therefore, when a user steps the foot controller 81, the drive force source 11 will be powered on, and sewing operations can be performed. When sewing thread breaks, the user can open the housing of the sewing machine, the gate of the housing safety switch 83 will be connected to the NC terminal of the housing safety switch 83. At this moment, if the aforementioned components are not pushed to the first position P1, namely, the first switch 59 is stilled being pressed by the swing arm 58 and connected to the NO terminal of the first switch 59, namely, the first and second circuits 831, 832 are open. Hence, any inadvertent action will not turn on the drive force source 11. When adjusted to the first position P1, the gate of the first switch 59 is connected to the NO terminal of the first switch 59, and the first circuit 831 is closed, so that pressing the second manual switch 84 can turn on the drive force source 11 and consequently make the air supply device 20 start to work, so as to form a multi-state safety control circuit, which improves the safety of whether to turn on the drive force source 11 or not. Another lamp 820 is serially connected to the circuit of the master switch 82.

It is to be noted that, only with the pipe-moving device 30 and the directional positioning device 70, the present invention is capable of ensuring safety air supply of the air supply device 20 by controlling the rotation of the main shaft 12 with the directional positioning device 70 which is affected by the movement of the pipe-moving device 30. The air supply device 20 can also be used in combination with the pipe-moving device 30, the air-supply clutch 60 and the connecting rod assembly 50 to ensure safety air supply.

While we have shown and described various embodiments in accordance with the present invention, it is clear to those skilled in the art that further embodiments may be made without departing from the scope of the present invention.

What is claimed is:

1. A sewing machine with a threading and air supply selecting device comprising: a base, a drive force source, a main shaft driven by the drive force source, at least one thread wiper driven by the main shaft, and a guiding pipe provided on the thread wiper, each of the guiding pipes having one end extended to a thread-inserting hole of the thread wiper, and another end fixed to a pipe-guiding frame of the thread wiper; characterized in that:

the drive force source driving an air supply device, between the air-supply device and the pipe-guiding frames is disposed a pipe-moving device which includes a pipe-moving frame and a connecting pipe mounted on the pipe-moving frame and connected to the air supply device, the pipe-moving frame is provided at one end thereof with a main guiding member, a position where the main guide member moves to a connection between the connecting pipe and the guiding pipe is defined as a first position, and a position where the main guiding member moves away from the connection between the connecting pipe and the guiding pipe is defined as a second position; and the main guiding member has one end connected to one end of a swing arm, another end of the swing arm is abutted against an air-supply clutch, the air-supply clutch is disposed on a power shaft of the drive force source, the swing arm, when in the first position, controls the air-supply clutch to transmit a drive force of the power shaft to the air supply device, or, the swing arm, when in the second position, controls the air-supply clutch to stop transmitting the drive force of the power shaft to the air supply device.

2. The sewing machine with the threading and air supply selecting device as claimed in claim 1, wherein the pipe-moving frame of the pipe-moving device includes a first wall, a second wall, and a lateral wall between the first and second walls, the connecting pipe is inserted through the first and second walls and provided with a stop member which is abutted against an abutting member to elastically push the connecting pipes toward the connecting pipe, the stop member is a flexible clasp;

a frame-sliding member is fixed to the base, on the first wall of the pipe-moving frame is defined an inserting hole for insertion of the frame-sliding rod, and the pipe-moving frame is slidably mounted on the frame-sliding rod, on the frame-sliding rod is sleeved a frame-abutting member pressed against the first wall of the pipe-moving frame to push the pipe-moving frame toward the guiding pipe;

the lateral wall of the pipe-moving frame is also provided with an extension portion which is inserted through a first restricting hole of a restricting portion of the base;

the main guiding member is provided with a folded end located corresponding to the first wall of the pipe-moving frame, the folded end is formed with an inserting hole for insertion of the frame-sliding rod and extends between the pipe-moving frame and the frame-sliding member, the pipe-moving frame is elastically pushed by the frame-abutting member against the folded end of the main guiding member, a pulling portion extends from the main guiding member for allowing the user to pull the main guiding member, and the main guiding member has a rear end extending through an elongated second restricting hole of the restricting portion, so as to drive the swing arm to move.

3. The sewing machine with the threading and air supply selecting device as claimed in claim 1, wherein the main guiding member drives the swing arm to move by using a connecting rod assembly which includes a first connecting rod pivoted to the main guiding member, a second connecting rod pivoted to the first connecting rod, a first rotary shaft fixed to and rotated by the second connecting rod, a third connecting rod fixed to and rotated by the first rotary shaft, a top shaft fixed to a free end of the third connecting rod, a fourth connecting rod pushed to move by the top shaft, and a second rotary shaft with one end fixed to the fourth connecting rod and another end fixed to the swing arm, the first and second rotary shafts are pivoted to the base, the swing arm is provided at a free end thereof with a hook portion for hooking an arm-pulling member with another end hooked to the base, so as to elastically push the swing arm toward the air-supply clutch, at the free end of the swing arm is further provided a wheel located toward the air-supply clutch.

4. The sewing machine with the threading and air supply selecting device as claimed in claim 1, wherein the air-supply clutch is disposed on the power shaft of the drive force source, the free end of the power shaft is provided with a first pulley which is drivingly connected to a second pulley disposed on the main shaft by a belt, the first pulley is provided on a face thereof toward the air-supply clutch with a plurality of teeth, the air-supply clutch includes a disc-shaped clutch member, an arm-driving member used in combination with the clutch member to drive a sway arm, a pivot seat pivoted to the arm-driving member, and a spring sleeved onto the power shaft to push the clutch member toward the first pulley, the clutch member is formed with a central pipe for insertion of the power shaft, and two opposite pin-inserting portions in the form of a slot located around the central pipe, the power shaft is provided with a drive hole running through a central axis of the power shaft, and a drive pin is inserted through the drive hole and into the pin-inserting portions of the clutch member;

the clutch member is provided on a surface with a pulley-engaging portion for engaging with the teeth of the first pulley, the wheel of the swing arm is pressed against an outer peripheral portion of a surface of the clutch member where the engaging portion is formed, around the peripheral portion of another surface of the clutch member are formed plural protrusions located toward the arm-driving member, the arm-driving member is provided on a surface with a plurality of cavities for engaging with the protrusions;

the arm-driving member is provided with a central pivot portion with a small axial hole, and an eccentric drive portion formed around the outer diameter of the central pivot portion, the eccentric drive portion is inserted through and driven to rotate by the sway arm;

the pivot seat is provided with an engaging portion and fixed to the base, the arm-driving member is pivotally sleeved onto the central protruding engaging portion, the spring is disposed in a central hollow portion of the pivot seat and has one end pushed against a limiting member on the power shaft and another end pushing toward the first pulley.

5. The sewing machine with the threading and air supply selecting device as claimed in claim 4, wherein the air supply device includes an air supply source and a swing rod which drives the air supply source to supply air, the swing rod is driven by the power shaft of the drive force source and consequently drives the air supply source, the air supply source is a diaphragm air cylinder with a cylinder head and an air pipe on the cylinder head, the cylinder head is disposed on a cylinder block to clamp a diaphragm which includes a cylinder rod pivoted to a free end of the swing rod, another end of the swing rod is pivoted to the base, and a middle section of the swing rod is pivoted to and driven to move by the free end of the sway arm, and the air supply device further includes a one-way air feeding device.

6. The sewing machine with the threading and air supply selecting device as claimed in claim 1, wherein the connecting rod assembly is provided with a first switch which is pressed by the swing arm, when the swing arm is disconnected from the air-supply clutch, so as to close a control circuit for controlling the drive force source, the control circuit used in combination with a foot controller, the control circuit comprises: a power source connected to the foot controller, the foot controller is connected to one end of a master switch, another end of the master switch is connected to a housing safety switch and the first switch, the first switch is then serially connected to the drive force source, an NC terminal and an NO terminal of the housing safety switch are connected to an NO terminal and an NC terminal of the first switch, respectively, the NO terminal of the housing safety switch is connected to the NC terminal of the first switch to form a first circuit, and another circuit is a second circuit, the drive force source is further serially connected with a second manual switch, and a lamp is serially connected to a circuit of the master switch.

7. A sewing machine with a threading and air supply selecting device comprising: a base, a drive force source, a main shaft driven by the drive force source, at least one thread wiper driven by the main shaft, and a guiding pipe provided on the thread wiper, each of the guiding pipes having one end extended to a thread-inserting hole of the thread wiper, and another end fixed to a pipe-guiding frame of the thread wiper; characterized in that:

an air supply device;

a pipe-moving device is disposed at the pipe-guiding frames and includes a pipe-moving frame and a connecting pipe mounted on the pipe-moving frame and connected to the air supply device, the pipe-moving frame is provided at one end thereof with a main guiding member, a position where the main guide member moves to a connection between the connecting pipe and the guiding pipe is defined as a first position, and a position where the main guiding member moves away from the connection between the connecting pipe and the guiding pipe is defined as a second position, the air supply device supplies air to the connecting pipe in the first position; and between the main guiding member and the main shaft is disposed a directional positioning device, the main guiding member includes a guiding edge with height difference, the guiding edge has a first end and a second end lower than the first end, the directional positioning device includes a limiter, and a rotation-stopping member mounted on the main shaft, the limiter has a middle section pivoted to the base, and has an abutting end protruding upward between a restricting member and the main guiding member, and a stop end protruding upward toward the main shaft, the abutting end is abutted against the guiding edge, the rotation-stopping member is provided with a rotation-stopping slot, when the pipe-moving frame is located in the first position, the abutting end will move to the second end of the guiding edge, and when the main shaft rotates to a position where the guiding pipe is aligned to the connecting pipe, the stop end will be engaged in the rotation-stopping slot to stop the main shaft from rotating, when the pipe-moving frame moves to the second position, the abutting end will move to the first end of the guiding edge, the stop end will be disengaged from the rotation-stopping slot to permit rotation of the main shaft.

8. The sewing machine with the threading and air supply selecting device as claimed in claim 7, wherein the pipe-moving frame of the pipe-moving device includes a first wall, a second wall, and a lateral wall between the first and second walls, the connecting pipe is inserted through the first and second walls and provided with a stop member which is abutted against an abutting member to elastically push the connecting pipes toward the connecting pipe, the stop member is a flexible clasp;

a frame-sliding member is fixed to the base, on the first wall of the pipe-moving frame is defined an inserting hole for insertion of the frame-sliding rod, and the pipe-moving frame is slidably mounted on the frame-sliding rod, on the frame-sliding rod is sleeved a frame-abutting member pressed against the first wall of the pipe-moving frame to push the pipe-moving frame toward the guiding pipe;

the lateral wall of the pipe-moving frame is also provided with an extension portion which is inserted through a first restricting hole of a restricting portion of the base;

the main guiding member is provided with a folded end located corresponding to the first wall of the pipe-moving frame, the folded end is formed with an inserting hole for insertion of the frame-sliding rod and extends between the pipe-moving frame and the frame-sliding member, the pipe-moving frame is elastically pushed by the frame-abutting member against the folded end of the main guiding member, a pulling portion extends from the main guiding member for allowing the user to pull the main guiding member, and the main guiding member has a rear end extending through an elongated second restricting hole of the restricting portion, so as to drive the swing arm to move.

9. The sewing machine with the threading and air supply selecting device as claimed in claim 7, wherein the directional positioning device further includes the restricting member which is an L-shaped plate with a horizontal portion and a perpendicular potion, the horizontal portion has a free end pivoted to the lateral wall of the pipe-moving frame by a pivot, the perpendicular portion is folded to form a cover portion which is slidably mounted on the top edge of the extension portion of the pipe-moving frame, the lower end of the cover portion is formed with an upward hooking portion for hooking one end of a first return member, providing a force for enabling the restricting member to rotate with respect to the pivot and pushing the cover portion toward the pipe-moving frame, the restricting member is provided with a first positioning portion which is located on the horizontal portion, and a second positioning portion which is located at the middle section of the horizontal portion;

a second return member is hooked to the abutting end to push the stop end toward the rotation stopping member;

the rotation-stopping slot is formed in an outer peripheral edge of the rotation-stopping member for engaging with or disengaging from the stop end to stop or unstop the rotation of the main shaft, when the pipe-moving frame moves to the first or second position, the abutting end will be stopped by the first or second positioning portion.

10. The sewing machine with the threading and air supply selecting device as claimed in claim 7, wherein the air supply device includes an air supply source and a swing rod which drives the air supply source to supply air, the swing rod is driven by the power shaft of the drive force source and consequently drives the air supply source, the air supply source is a diaphragm air cylinder with a cylinder head and an air pipe on the cylinder head, the cylinder head is disposed on a cylinder block to clamp a diaphragm which includes a cylinder rod pivoted to a free end of the swing rod, another end of the swing rod is pivoted to the base, and a middle section of the swing rod is pivoted to and driven to move by the free end of the sway arm, and the air supply device further includes a one-way air feeding device.

11. A sewing machine with a threading and air supply selecting device comprising: a base, a drive force source, a main shaft driven by the drive force source, at least one thread wiper driven by the main shaft, and a guiding pipe provided on the thread wiper, each of the guiding pipes having one end extended to a thread-inserting hole of the thread wiper, and another end fixed to a pipe-guiding frame of the thread wiper; characterized in that:

the drive force source driving an air supply device, between the air-supply device and the pipe-guiding frames is disposed a pipe-moving device which includes a pipe-moving frame and a connecting pipe mounted on the pipe-moving frame and connected to the air supply device, the pipe-moving frame is provided at one end thereof with a main guiding member, a position where the main guide member moves to a connection between the connecting pipe and the guiding pipe is defined as a first position, and a position where the main guiding member moves away from the connection between the connecting pipe and the guiding pipe is defined as a second position; and between the main guiding member and the main shaft is disposed a directional positioning device, the main guiding member includes a guiding edge with height difference, the guiding edge has a first end and a second end lower than the first end, the directional positioning device includes a limiter, and a rotation-stopping member mounted on the main shaft, the limiter has a middle section pivoted to the base, and has an abutting end protruding upward between a restricting member and the main guiding member, and a stop end protruding upward toward the main shaft, the abutting end is abutted against the guiding edge, the rotation-stopping member is provided with a rotation-stopping slot, when the pipe-moving frame is located in the first position, the abutting end will move to the second end of the guiding edge, and when the main shaft rotates to a position where the guiding pipe is aligned to the connecting pipe, the stop end will be engaged in the rotation-stopping slot to stop the main shaft from rotating, when the pipe-moving frame moves to the second position, the abutting end will move to the first end of the guiding edge, the stop end will be disengaged from the rotation-stopping slot to permit rotation of the main shaft;

the main guiding member has one end connected to one end of a swing arm, another end of the swing arm is abutted against an air-supply clutch, the air-supply clutch is disposed on a power shaft of the drive force source, the swing arm, when in the first position, controls the air-supply clutch to transmit a drive force of the power shaft to the air supply device, or, the swing arm, when in the second position, controls the air-supply clutch to stop transmitting the drive force of the power shaft to the air supply device.

12. The sewing machine with the threading and air supply selecting device as claimed in claim 11, wherein the pipe-moving frame of the pipe-moving device includes a first wall, a second wall, and a lateral wall between the first and second walls, the connecting pipe is inserted through the first and second walls and provided with a stop member which is abutted against an abutting member to elastically push the connecting pipes toward the connecting pipe, the stop member is a flexible clasp;

a frame-sliding member is fixed to the base, on the first wall of the pipe-moving frame is defined an inserting hole for insertion of the frame-sliding rod, and the pipe-moving frame is slidably mounted on the frame-sliding rod, on the frame-sliding rod is sleeved a frame-abutting member pressed against the first wall of the pipe-moving frame to push the pipe-moving frame toward the guiding pipe;

the lateral wall of the pipe-moving frame is also provided with an extension portion which is inserted through a first restricting hole of a restricting portion of the base;

the main guiding member is provided with a folded end located corresponding to the first wall of the pipe-moving frame, the folded end is formed with an inserting hole for insertion of the frame-sliding rod and extends between the pipe-moving frame and the frame-sliding member, the pipe-moving frame is elastically pushed by the frame-abutting member against the folded end of the main guiding member, a pulling portion extends from the main guiding member for allowing the user to pull the main guiding member 38, and the main guiding member has a rear end extending through an elongated second restricting hole of the restricting portion, so as to drive the swing arm to move, and to the bottom of the main guiding member is fixed a positioning device which can produce a locking action in the first and second positions.

13. The sewing machine with the threading and air supply selecting device as claimed in claim 12, wherein the positioning device includes an elastic member and a positioning member, the elastic member is an elastic piece which is provided with a directional portion folded toward and inserted through the main guiding member, the elastic member is fixed to the main guiding member by a bolt, the elastic member is provided with an elastic portion which is folded toward the positioning member, and at the end of the elastic portion is formed an engaging portion, the positioning member is provided with a first positioning portion and a second positioning portion for engaging with the engaging portion in the first and second positions.

14. The sewing machine with the threading and air supply selecting device as claimed in claim 11, wherein the directional positioning device further includes the restricting member which is an L-shaped plate with a horizontal portion and a perpendicular potion, the horizontal portion has a free end pivoted to the lateral wall of the pipe-moving frame by a pivot, the perpendicular portion is folded to form a cover portion which is slidably mounted on the top edge of the extension portion of the pipe-moving frame, the lower end of the cover portion is formed with an upward hooking portion for hooking one end of a first return member, providing a force for enabling the restricting member to rotate with respect to the pivot and pushing the cover portion toward the pipe-moving frame, the restricting member is provided with a first positioning portion which is located on the horizontal portion, and a second positioning portion which is located at the middle section of the horizontal portion;

a second return member is hooked to the abutting end to push the stop end toward the rotation stopping member;

the rotation-stopping slot is formed in an outer peripheral edge of the rotation-stopping member for engaging with or disengaging from the stop end to stop or unstop the rotation of the main shaft, when the pipe-moving frame moves to the first or second position, the abutting end will be stopped by the first or second positioning portion.

15. The sewing machine with the threading and air supply selecting device as claimed in claim 11, wherein the main guiding member drives the swing arm to move by using a connecting rod assembly which includes a first connecting rod pivoted to the main guiding member, a second connecting rod pivoted to the first connecting rod, a first rotary shaft fixed to and rotated by the second connecting rod, a third connecting rod fixed to and rotated by the first rotary shaft, a top shaft fixed to a free end of the third connecting rod, a fourth connecting rod pushed to move by the top shaft, and a second rotary shaft with one end fixed to the fourth connecting rod and another end fixed to the swing arm, the first and second rotary shafts are pivoted to the base, the swing arm is provided at a free end thereof with a hook portion for hooking an arm-pulling member with another end hooked to the base, so as to elastically push the swing arm toward the air-supply clutch, at the free end of the swing arm is further provided a wheel located toward the air-supply clutch.

16. The sewing machine with the threading and air supply selecting device as claimed in claim 11, wherein the air-supply clutch is disposed on the power shaft of the drive force source, the free end of the power shaft is provided with a first pulley which is drivingly connected to a second pulley disposed on the main shaft by a belt, the first pulley is provided on a face thereof toward the air-supply clutch with a plurality of teeth, the air-supply clutch includes a disc-shaped clutch member, an arm-driving member used in combination with the clutch member to drive a sway arm, a pivot seat pivoted to the arm-driving member, and a spring sleeved onto the power shaft to push the clutch member toward the first pulley, the clutch member is formed with a central pipe for insertion of the power shaft, and two opposite pin-inserting portions in the form of a slot located around the central pipe, the power shaft is provided with a drive hole running through a central axis of the power shaft, and a drive pin is inserted through the drive hole and into the pin-inserting portions of the clutch member;

the clutch member is provided on a surface with a pulley-engaging portion for engaging with the teeth of the first pulley, the wheel of the swing arm is pressed against an outer peripheral portion of a surface of the clutch member where the engaging portion is formed, around the peripheral portion of another surface of the clutch member are formed plural protrusions located toward the arm-driving member, the arm-driving member is provided on a surface with a plurality of cavities for engaging with the protrusions;

the arm-driving member is provided with a central pivot portion with a small axial hole, and an eccentric drive portion formed around the outer diameter of the central pivot portion, the eccentric drive portion is inserted through and driven to rotate by the sway arm;

the pivot seat is provided with an engaging portion and fixed to the base, the arm-driving member is pivotally sleeved onto the central protruding engaging portion, the spring is disposed in a central hollow portion of the pivot seat and has one end pushed against a limiting member on the power shaft and another end pushing toward the first pulley.

17. The sewing machine with the threading and air supply selecting device as claimed in claim 16, wherein the air supply device includes an air supply source and a swing rod which drives the air supply source to supply air, the swing rod is driven by the power shaft of the drive force source and consequently drives the air supply source, the air supply source is a diaphragm air cylinder with a cylinder head and an air pipe on the cylinder head, the cylinder head is disposed on a cylinder block to clamp a diaphragm which includes a cylinder rod pivoted to a free end of the swing rod, another end of the swing rod is pivoted to the base, and a middle section of the swing rod is pivoted to and driven to move by the free end of the sway arm, and the air supply device further includes a one-way air feeding device.

18. The sewing machine with the threading and air supply selecting device as claimed in claim 11, wherein the connecting rod assembly is provided with a first switch which is pressed by the swing arm, when the swing arm is disconnected from the air-supply clutch, so as to close a control circuit for controlling the drive force source, the control circuit used in combination with a foot controller, the control circuit comprises: a power source connected to the foot controller, the foot controller is connected to one end of a master switch, another end of the master switch is connected to a housing safety switch and the first switch, the first switch is then serially connected to the drive force source, an NC terminal and an NO terminal of the housing safety switch are connected to an NO terminal and an NC terminal of the first switch, respectively, the NO terminal of the housing safety switch is connected to the NC terminal of the first switch to form a first circuit, and another circuit is a second circuit, the drive force source is further serially connected with a second manual switch, and a lamp is serially connected to a circuit of the master switch.

* * * * *